US008725030B2

(12) United States Patent
Okano et al.

(10) Patent No.: US 8,725,030 B2
(45) Date of Patent: May 13, 2014

(54) IMAGE FORMING APPARATUS

(75) Inventors: Tetsuya Okano, Aichi (JP); Hiroshige Hiramatsu, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 183 days.

(21) Appl. No.: 13/362,153

(22) Filed: Jan. 31, 2012

(65) Prior Publication Data

US 2012/0224883 A1 Sep. 6, 2012

(30) Foreign Application Priority Data

Mar. 1, 2011 (JP) ..... 2011-044259

(51) Int. Cl.
*G03G 15/16* (2006.01)

(52) U.S. Cl.
USPC ..... 399/101; 399/66; 399/121; 399/254; 399/297

(58) Field of Classification Search
USPC ..... 399/66, 101, 121, 254, 297, 302
See application file for complete search history.

(56) References Cited

U.S. PATENT DOCUMENTS

| | | | | |
|---|---|---|---|---|
| 6,477,344 | B1 | 11/2002 | Asakura et al. | |
| 2007/0008397 | A1 | 1/2007 | Maebashi | |
| 2008/0056758 | A1 * | 3/2008 | Kawamata | 399/101 |
| 2009/0190951 | A1 * | 7/2009 | Torimaru et al. | 399/101 |

FOREIGN PATENT DOCUMENTS

| | | | |
|---|---|---|---|
| JP | H05-265271 | A | 10/1993 |
| JP | H08-146695 | A | 6/1996 |
| JP | H08-278710 | A | 10/1996 |
| JP | H10-049019 | A | 2/1998 |
| JP | H11-052748 | A | 2/1999 |
| JP | 2000-075571 | A | 3/2000 |
| JP | 2000-147914 | A | 5/2000 |
| JP | 2000-338793 | A | 12/2000 |
| JP | 2003-029588 | A | 1/2003 |
| JP | 2004-045457 | A | 2/2004 |
| JP | 2007-041582 | A | 2/2007 |
| JP | 2007-093648 | A | 4/2007 |
| JP | 2007-114614 | A | 5/2007 |
| JP | 2007-334011 | A | 12/2007 |

OTHER PUBLICATIONS

Japan Patent Office, Notification of Reasons for Rejection for Japanese Patent Application No. 2012-021593 (counterpart to above-captioned patent application), mailed Jul. 30, 2013.

* cited by examiner

*Primary Examiner* — Walter L Lindsay, Jr.
*Assistant Examiner* — Roy Y Yi
(74) *Attorney, Agent, or Firm* — Baker Botts L.L.P.

(57) ABSTRACT

An image forming apparatus is provided. The image forming apparatus includes an image forming unit to form a developer image in a developer agent on a photosensitive member, an intermediate transfer member arranged in a position to face the photosensitive member, a primary transfer member to transfer the developer image from the photosensitive member to the intermediate transfer member, a secondary transfer member to transfer the developer image from the intermediate transfer member to the recording medium, a cleaning member to remove materials adhered onto the intermediate transfer member, a container to store the materials removed from the intermediate transfer member, an attachment section, to which the container is detachably attached, and a conveyer to convey the recording medium to pass through a position between the intermediate transfer member and the cleaning member.

20 Claims, 15 Drawing Sheets

| | SECONDARY TRANSFER OPERATION | CLEANING OPERATION |
|---|---|---|
| APPLIED VOLTAGE LEVEL TO THE SECONDARY TRANSFER ROLLER | V1 | V2 (\|V1\|>\|V2\|) |
| ROTATION VELOCITY OF THE SECONDARY TRANSFER ROLLER WITH RESPECT TO INTERMEDIATE TRANSFER BELT | SAME | HIGHER |

FIG. 3

〔SECONDARY TRANSFER OPERATION〕

〔CLEANING OPERATION〕

IMAGE FORMING APPARATUS

CROSS REFERENCE TO RELATED APPLICATION

This application claims priority from Japanese Patent Application No. 2011-044259, filed on Mar. 1, 2011, the entire subject matter of which is incorporated herein by reference.

BACKGROUND

Technical Field

An aspect of the present invention relates to an image forming apparatus, which is configured to form an image on a recording medium in an intermediate-transfer image-forming method.

An image forming apparatus, which forms an image on a recording medium (e.g., a sheet of paper) in an intermediate-transfer image-forming method, is known. In a known intermediate-transfer image-forming method, toner images in a plurality of (e.g., four) colors are laid over one another on an intermediate transfer, which is an endless belt, and the overlaid toner images are transferred onto a recording sheet at a time. After transferring the toner images onto the recording sheet, some of the toners may remain on the intermediate transfer belt, and it may be required to remove the residual toners from the intermediate transfer belt in order to repeatedly use the same intermediate transfer belt. Therefore, in order to remove the residual toners, the image forming apparatus is often equipped with a cleaning device. The cleaning device may be, for example, arranged on a same side with respect to a sheet conveyer path as the intermediate transfer belt.

SUMMARY

With the cleaning device to remove the residual toners from the intermediate transfer belt, a waste toner container to store the removed residual toners may be required, and the cleaning device may become voluminous. When the voluminous cleaning device is installed in the image forming apparatus, a position of the cleaning device may be determined in consideration of the other components in the image forming apparatus, such as parts of an image forming unit, in order to avoid interference with the components. In other words, the position the cleaning device may be restricted by the other components.

In view of such restriction, the present invention is advantageous in that an intermediate-transfer image forming apparatus, in which more flexible layout of the components is permitted, is provided.

According to an aspect of the present invention, an image forming apparatus is provided. The image forming apparatus includes an image forming unit, which includes a photosensitive member and is configured to form a developer image in a developer agent on the photosensitive member, an intermediate transfer member, which is arranged in a position to face the photosensitive member, a primary transfer member, which is configured to transfer the developer image from the photosensitive member to the intermediate transfer member, a secondary transfer member, which is configured to transfer the developer image from the intermediate transfer member to a recording medium, a cleaning member, which is configured to remove materials adhered onto the intermediate transfer member, a container, which is configured to store the materials removed from the intermediate transfer member, an attachment section, to which the container is detachably attached, and a conveyer, which is configured to convey the recording medium to pass through a position between the intermediate transfer member and the cleaning member.

According to another aspect of the present invention, an image forming apparatus is provided. The image forming unit includes an image forming unit, which includes a photosensitive member and is configured to form a developer image in a developer agent on the photosensitive member, an intermediate transfer member, which is arranged in a position to face the photosensitive member, a primary transfer member, which is configured to transfer the developer image from the photosensitive member to the intermediate transfer member, a secondary transfer member, which is configured to have a secondary-transfer function to transfer the developer image from the intermediate transfer member to a recording medium and a cleaning function to remove materials adhered onto the intermediate transfer member, a container, which is configured to store the materials removed from the intermediate transfer member by the secondary transfer member, a controller, which is configured to control a difference between a moving velocity of the intermediate transfer member and a moving velocity of the secondary transfer member at a secondary transfer position, in which the developer image is transferred to the recording medium. The secondary transfer member is configured to transfer the developer image from the intermediate transfer member to the recording medium during a secondary-transfer operation period and functions as the cleaning member during a cleaning operation period, in which the materials is removed from the intermediate transfer member by the secondary transfer member. The controller controls the difference between the moving velocity of the intermediate transfer member and the moving velocity of the secondary transfer member at the secondary transfer position to be a first difference during the secondary-transfer operation period. The controller controls the difference between the moving velocity of the intermediate transfer member and the moving velocity of the secondary transfer member at the secondary transfer position to be a second difference during the cleaning operation period. The second difference is greater than the first difference.

BRIEF DESCRIPTION OF THE ACCOMPANYING DRAWINGS

FIG. 3 is a table to illustrate relations between rotation velocities of a secondary transfer roller and applied voltages in a secondary transfer operation and a cleaning operation in the laser printer according to the first embodiment of the present invention.

DETAILED DESCRIPTION

Hereinafter, embodiments of the present invention will be described with reference to the accompanying drawings.

First Embodiment

1. Overall Configuration of Laser Printer

Figure 1:
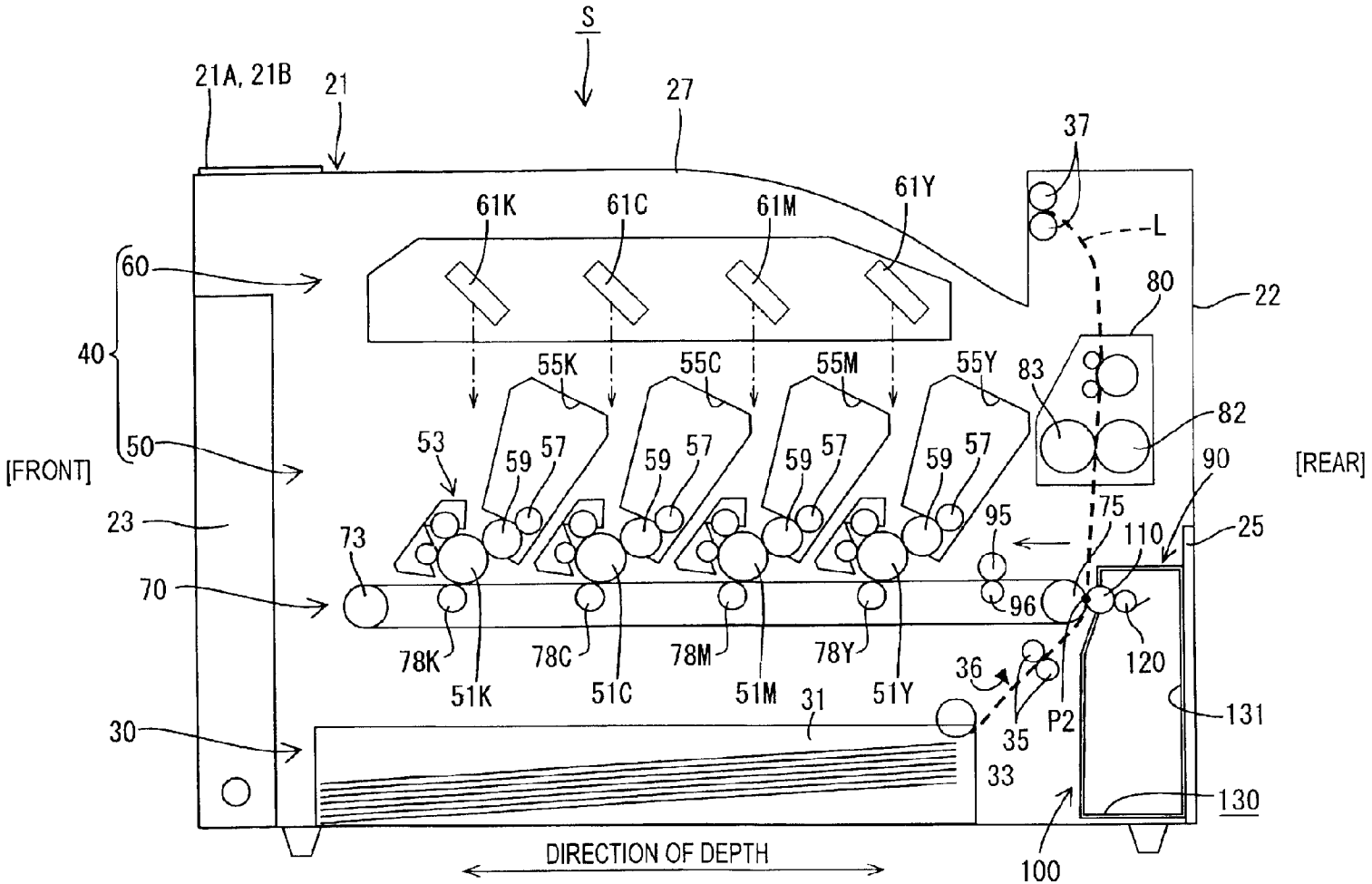
FIG. 1 is a cross-sectional view of a laser printer according to a first embodiment of the present invention.
Figure 2:
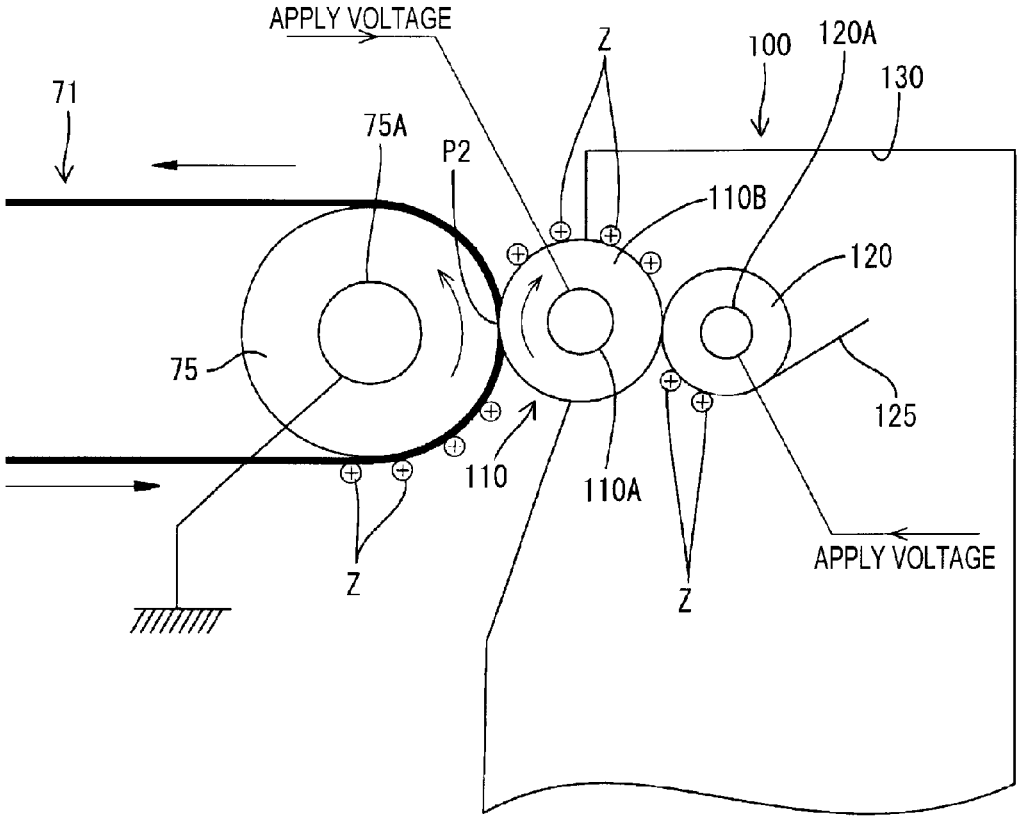
FIG. 2 is an enlarged partial view of a cleaning device in the laser printer according to the first embodiment of the present invention.

A first embodiment of a laser printer S according to the present invention will be described with reference to FIGS. 1-8. In the present embodiment described below, directions concerning the laser printer 1 will be referred to on basis of a user's position to ordinarily use the laser printer 1 and in accordance with orientation indicated by an arrow shown in FIG. 1. That is, a viewer's left-hand side appearing in FIG. 1 is referred to as a front face of the laser printer 1. On a top plane of the laser printer S, on the left-hand side, an operation unit including an operation panel 21A and a display 21B, through which the user can manipulate the laser printer S, is provided. Meanwhile, a right-hand side in FIG. 1 opposite from the front is referred to as rear. The front-rear direction of the laser printer S may also be referred to as a direction of depth. A side, which corresponds to the viewer's nearer side is referred to as a left-side face, and an opposite side from the left, which corresponds to the viewer's further hand side, is referred to as a right-side face. The right-left direction of the laser printer S, which is perpendicular to the direction of depth, may also be referred to as a widthwise direction. The up-down direction in FIG. 1 corresponds to a vertical direction of the laser printer 1.

The laser printer S according to the present embodiment is an image forming apparatus capable of forming multi-colored images in an intermediate-transfer tandem method. The laser printer S has a casing 21 being a chassis, which contains a sheet-feeder unit 30 in a lower section, and from a rear end of the sheet-feeder unit 30, a conveyer path L to guide a recording medium upward is formed.

The conveyer path L, as indicated in a dotted line FIG. 1, starts from the rear end of the sheet-feeder unit 30 and extends in an upper-rear direction to a secondary transfer position P2. From the secondary transfer position P2, the conveyer path L extends upward to reach an upper-rear end of the casing 21. At the upper-rear end of the casing 21, the conveyer path L turns frontward to reach a discharge tray 27, which is formed in a top plane of the casing 21. Thus, the recording medium is guided to the secondary transfer position P2 and in the conveyer path L settled in the discharge tray 27. The front side of the casing 21 is partially covered with a front cover 23, which is pivotable about a hinge (not shown) to cover and uncover the front face of the casing 21. Further, the rear side of the casing 21 is partially covered with a rear cover 25, which is pivotable about a hinge (not shown) to expose and cover the rear face of the casing 21.

2. Components

The laser printer S includes the sheet-feeder unit 30, an intermediate transfer belt unit 70, an image forming unit 40 having a processing unit 50 and a scanner unit 60, a fixing unit 80, and a cleaning device 100. In the casing 21, the sheet-feeder unit 30, the intermediate transfer belt unit 70, the processing unit 50, and the scanner unit 60 are arranged in stack, from bottom to top, in the order mentioned above. The sheet-feeder unit 30 includes a sheet cassette 31 to contain recording sheets being recording media, a sheet-feed roller 33 to pick up the recording sheets one-by-one from the sheet cassette 31, and register rollers 35. The recording sheets are picked up by the sheet-feed roller 33 and forwarded in the conveyer path L.

A sheet sensor 36 is a sensor to detect the recording sheet approaching the register rollers 35. The register rollers 35 set the recording sheet having been conveyed in the conveyer path L in a correct orientation with respect to the secondary transfer position P2 before the recording sheet reaches the secondary transfer position P2. More specifically, rotation of the register rollers 35 is stopped at a predetermined timing based on a detected result from the sheet sensor 36 before a front end of the recording sheet reaches the register rollers 35. Accordingly, the recording sheet is restricted from being forwarded in between the register rollers 35 and blocked thereat. In this regard, the front end of the recording sheet is urged against the register rollers 35, and when the recording sheet is in an oblique orientation with respect to the conveyer path L, the orientation of the recording sheet is straightened with respect to the conveyer path L by conveying force of the sheet-feed roller 33. Thereafter, rotation of the register rollers 35 is resumed, and the recording sheet in the corrected orientation is forwarded to the secondary transfer position P2. In this regard, the front end of the recording sheet refers to an edge, which enters firstly in the conveyer path L earlier than the remaining of the recording sheet and is closer to a destination (i.e., the discharge tray 27) of the sheet-conveyance.

The processing unit 50 is arranged in an upper position with respect to the intermediate transfer belt unit 70 and in a vertically central position in the casing 2. The processing unit 50 includes a photosensitive drum 51, a charger 53, a toner box 55, a supplier roller 57, and a developer roller 59 for each of toners in four colors. The toner boxes 55 are provided respectively for the four colors of toners being developer agents, and the four colors of the toners are, for example, cyan (C), magenta (M), yellow (Y), and black (K). In the present embodiment, the four toner boxes 55Y, 55M, 55C, 55K are arranged in line along the direction of depth in the casing 2.

At a lower end section of each toner box 55Y, 55M, 55C, 55K, the supplier roller 57 and the developer roller 59 are arranged to confront each other. Further, the photosensitive drums 51Y, 51M, 51C, 51K are arranged in positions to confront each of the developer rollers 59. The chargers 53 to positively charge surfaces of the photosensitive drums 51Y, 51M, 51C, 51K uniformly are arranged in upper positions with respect to the photosensitive drums 51Y, 51M, 51C, and 51K.

The scanner unit 60 is arranged in an upper position with respect to the processing unit 50 and includes four laser scanners 61Y, 61M, 61C, 61K, which are arranged in positions corresponding to the photosensitive drums 51Y, 51M, 51C, 51K respectively. Each of the laser scanners 61Y, 61M, 61C, 61K includes a laser diode (LD), which emits a laser beam to scan the surface of the photosensitive drum 51Y, 51M, 51C, 51K. Light paths of the laser beams emitted from the laser diodes in the laser scanners 61Y, 61M, 61C, 61K are indicated in dash-and-dot lines in FIG. 1.

The intermediate transfer belt unit 70 includes a pair of rollers, which are a driving roller 73 and a backup roller 75. The intermediate transfer belt unit 70 further includes an intermediate transfer belt 71, which is an endless belt arranged encircle the pair of rollers 73, 75. The intermediate transfer belt unit 70 is arranged in a position between the sheet-feeder unit 30 and the processing unit 50 in a horizontally-laid posture. More specifically, the intermediate transfer belt 71 is arranged to vertically face the four photosensitive drums 51Y, 51M, 51C, 51K, and an upper outer surface of the intermediate transfer belt 71 is in contact with lower ends of the photosensitive drums 51Y, 51M, 51C, 51K.

The intermediate transfer belt 71 is made of, for example, resin such as polycarbonate, and is formed to have a width, which is larger than a width of a recording sheet of a maximum printable size (e.g., a letter size). When driving force from a main motor 161 is transmitted to the driving roller 73, the driving roller 73 rotates, and the intermediate transfer belt 71 is driven to roll around the pair of rollers 73, 75 in a direction indicated by an arrow shown in FIG. 1 (i.e., from rear toward front with regard to the upper portion of the intermediate transfer belt 71). The main motor 161 serves as a driving source for movable parts such as rollers (e.g., the sheet-feed roller 33, the register rollers 35, primary transfer rollers 78, and a secondary transfer roller 110) and the photosensitive drums 51.

In the intermediate transfer belt unit 70, primary transfer rollers 78Y, 78M, 78C, 78K are arranged in positions opposite from the photosensitive drums 51Y, 51M, 51C, 51K across the intermediate transfer belt 71. The primary transfer rollers 78Y, 78M, 78C, 78K with primary transfer voltage serve to transfer toner images, which are formed on the photosensitive drums 51Y, 51M, 51C, 51K, onto the outer surface of the intermediate transfer belt 71.

Further, in the intermediate transfer belt unit 70, the secondary transfer roller 110 is arranged in a rear position with respect to the backup roller 75 across the intermediate transfer belt 71. The secondary transfer roller 110 includes a roller shaft 110A made of a metal and an outer layer 110B, which surrounds an outer peripheral surface of the roller shaft 110A (see FIG. 2). The roller shaft 110A extends in parallel with the widthwise direction of the intermediate transfer belt 71 and is controlled by a CPU 151 (see FIG. 7) to rotate. The outer layer 110B is made of a porous material (e.g., conductive urethane foam). In the secondary transfer roller 110, secondary transfer voltage V1 being negative voltage is impressed by a secondary transfer bias applying circuit 171 (see FIG. 7) to the roller shaft 110A. Meanwhile, a roller shaft 75A of the backup roller 75 is grounded; therefore, when the secondary transfer voltage V1 is impressed to the roller shaft 110A of the secondary transfer roller 110, an electric field directed from the backup roller 75 toward the secondary transfer roller 110 is generated. Due to an effect of the generated electric field, the toner images primarily transferred onto the intermediate transfer belt 71 is secondarily transferred onto a surface of the recording sheet at the secondary transfer position P2.

In the present embodiment, in addition to the role as the secondary transfer roller, the secondary transfer roller 110 also serves as a cleaning roller, which can clean the outer surface of the intermediate transfer belt 71, as a part of a cleaning device 100. The intermediate transfer belt 71 can be cleaned by the secondary transfer roller 110 in a basically same method as the secondary transfer of the toner images onto the recording sheet. That is, when negative cleaning voltage is impressed to the secondary transfer roller 110, the residual toners Z on the surface of the intermediate transfer belt 71 are removed therefrom. More specifically, when negative cleaning voltage V2 is impressed to the secondary transfer roller 110, an electric field directed from the backup roller 75 toward the secondary transfer roller 110 is generated. Due to an effect of the generated electric field, residual toners Z (see FIG. 2) on the surface of the intermediate transfer belt 71 are absorbed by secondary transfer roller 110.

In the present embodiment, levels of the voltages V1, V2 to be applied to the secondary transfer roller 110 are changed between the secondary transfer operation and the cleaning operation. In particular, an absolute value of the cleaning voltage V2 is set to be lower than an absolute value of the secondary transfer voltage V1 (see FIG. 3). For example, when the secondary transfer voltage V1 is −1500V, the cleaning voltage V2 may be −1000V. The difference in voltage levels is created in consideration of a reason that, during a secondary transfer operation, the recording sheet exists in the position between the intermediate transfer belt 71 and the secondary transfer roller 110, and the voltage is required to be higher for an amount of resistance caused in the recording sheet. On the other hand, during a cleaning operation, the resistance due to the recording sheet is cleared, and residual toners Z can be removed by the lower voltage.

Further, in the present embodiment, rotation velocities of the secondary transfer roller 110 are changed between the secondary transfer operation and the cleaning operation. That is, during the secondary transfer operation, the secondary transfer roller 110 is rotated in a same direction at a same rotation velocity as a rolling velocity of the intermediate transfer belt 71 under control of a CPU 151 in an engine controller 150 (see FIG. 7). During the cleaning operation, on the other hand, the secondary transfer roller 110 is rotated in the same direction as the intermediate transfer belt 71 but at a higher rotation velocity than the moving velocity of the intermediate transfer belt 71 under control of the CPU 151 in the engine controller 150. In this regard, concerning the moving directions of the secondary transfer roller 110 and the intermediate transfer belt 71, the "same direction" refers to the direction of travel of the secondary transfer roller 110 and the intermediate transfer belt 71 at the secondary transfer position P2. That is, when the secondary transfer roller 110 and the intermediate transfer belt 71 are in the same rotating direction, the secondary transfer roller 110 and the intermediate transfer belt 71 are moved in the same direction at the secondary transfer position P2 (e.g., upward in FIG. 2).

When the intermediate transfer belt 71 and the secondary transfer roller 110 are rotated in different moving velocities during the cleaning operation, an amount of friction caused in the position P2 between the intermediate transfer belt 71 and the secondary transfer roller 110 becomes greater compared to an amount of friction caused during the secondary transfer operation. Therefore, the residual toners Z can be more effectively removed from the intermediate transfer belt 71 by the effect of the friction.

In the present embodiment, therefore, the secondary transfer roller 110 is usable in at least two ways and can serve as a secondary transfer roller and a cleaning device. When the secondary transfer roller 110 is not used for the secondary transfer operation but used for the cleaning operation to remove the residual toners Z from the intermediate transfer belt 71, the difference between the velocity of travel for the intermediate transfer belt 71 and the velocity of travel for the secondary transfer roller 110 at the secondary transfer position P2 is controlled by the CPU 151 in the engine controller 150 to be greater than a difference between the velocity of travel for the intermediate transfer belt 71 and the velocity of travel for the secondary transfer roller 110 during the secondary transfer operation.

Figure 4:
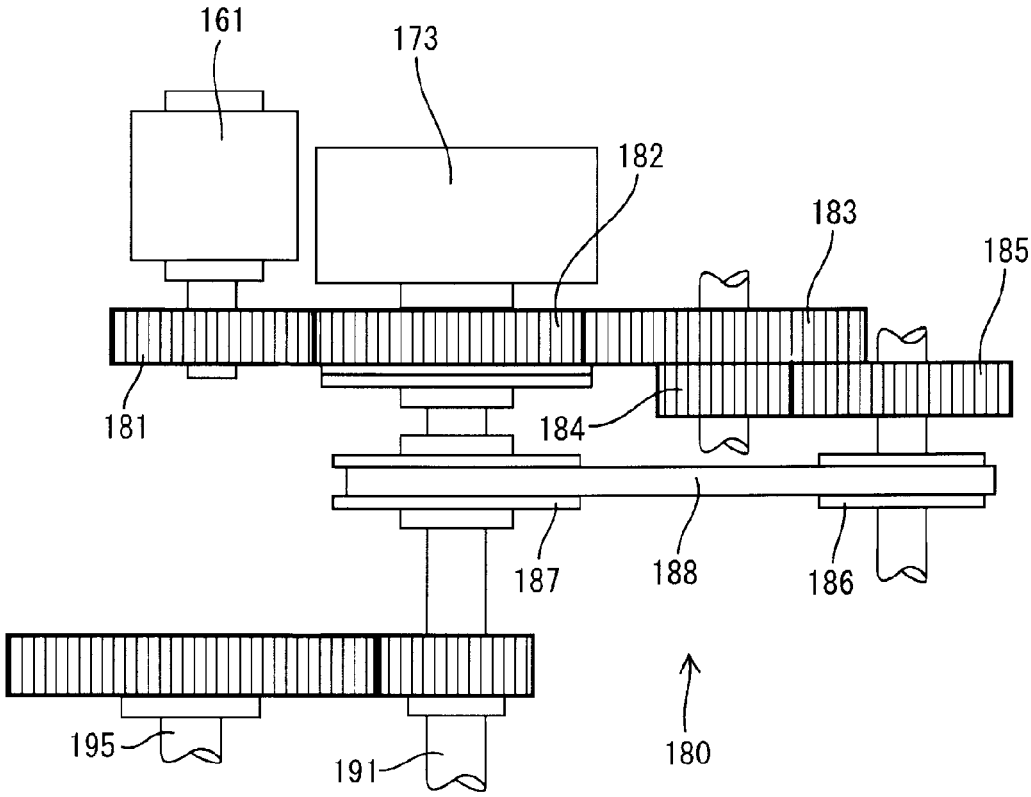
FIG. 4 is an enlarged view of a transmission system to switch the rotation velocities of the secondary transfer roller in the laser printer according to the first embodiment of the present invention.
Figure 5A:
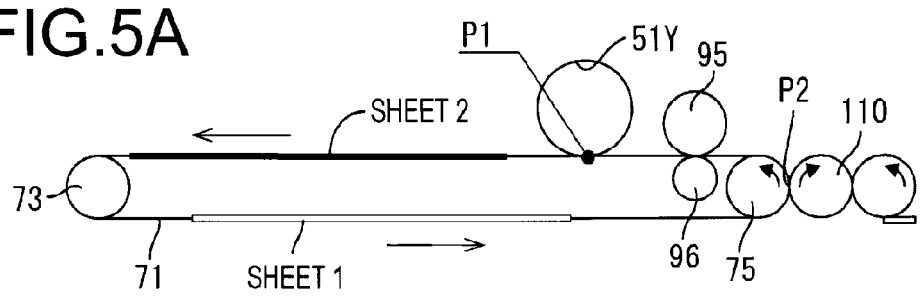
FIGS. 5A-5E illustrate behaviors of an auxiliary cleaning roller, which collects and releases residual toners from the intermediate transfer belt, in the laser printer according to the first embodiment of the present invention.
Figure 5B:
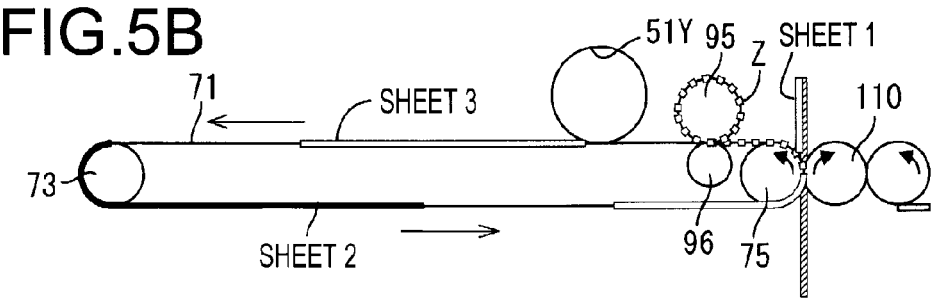
Figure 5C:
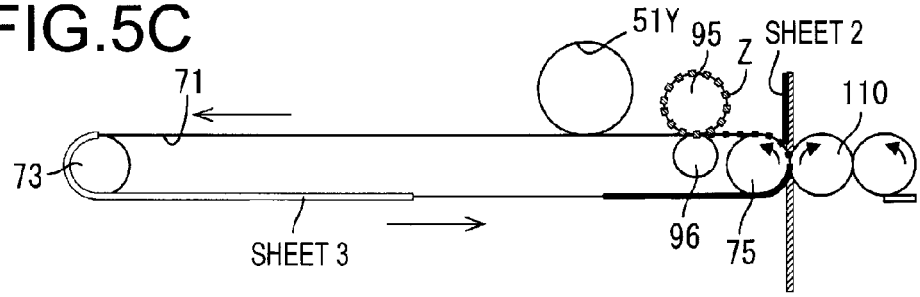
Figure 5D:
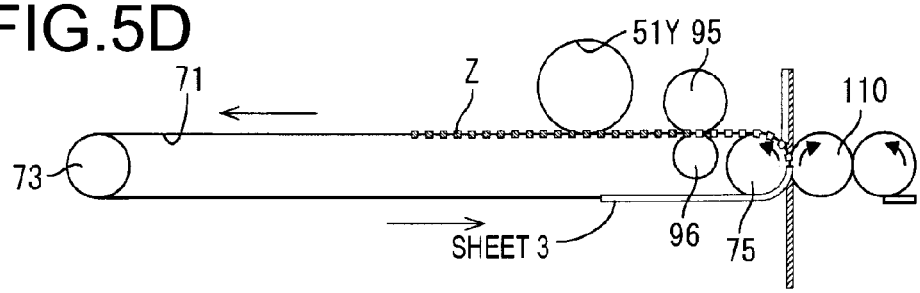
Figure 5E:
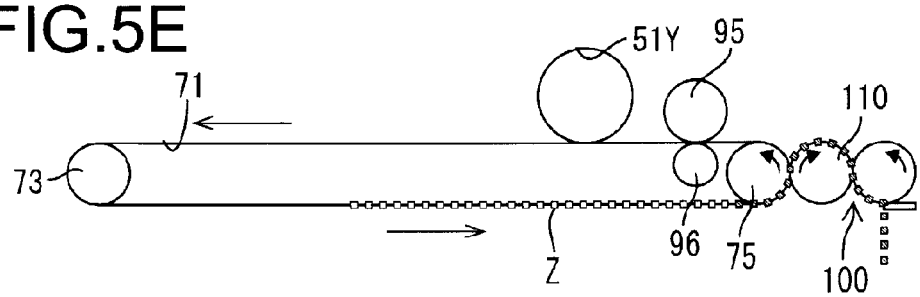

The rotation velocities of the secondary transfer roller 110 may be changed, for example, by switching gear trains which transmit the driving force of the main motor 161. In the present embodiment, a transmission system 180 with a speed-changeable electromagnetic clutch 173 (e.g., a dry clutch) is employed. As shown in FIG. 4, the transmission system 180 includes the main motor 161, a motor gear 181, a transmission gear 182, reduction gears 183, 184, 185, a pulley 186, a one-way clutch integrated pulley 187, a timing belt 188, a drive shaft 191, a rotation shaft 195 for the secondary transfer roller 110.

In the transmission system 180, when the electromagnetic clutch 173 is switched off, the driving force from the main motor 161 is transmitted to the drive shaft 191 via the motor gear 181 and the transmission gear 182 without being interfered with by the electromagnetic clutch 173. Therefore, the drive shaft 191 is driven in a higher velocity without being affected by the electromagnetic clutch 173, and the secondary transfer roller 110 is rotated in the higher velocity. When the electromagnetic clutch 173 is switched on, the driving force from the main motor 161 is transmitted to the drive shaft 191 in a reduced speed via the motor gear 181, the transmission gear 182, the reduction gears 183-185, and the timing belt 188. Thus, the drive shaft 191 is driven in a lower velocity, and the second transfer roller 110 is rotated in the lower velocity.

Referring again to FIG. 1, the fixing unit 80 is arranged in a rear position with respect to the processing unit 50 and an upper position with respect to a waste toner box 130, which will be described later in detail. The fixing unit 80 includes a heat roller 83 and a pressure roller 82, which are arranged in positions to face each other across the conveyer path L. The heat roller 83 includes a halogen lamp (not shown) as a heat source. When the recording sheet with the secondarily-transferred toner images is conveyed in the position between the heat roller 83 and the pressure roller 82, the secondarily-transferred toner images are thermally fixed thereat on the recording sheet by the heat of the heat roller 83.

An auxiliary cleaning roller 95 and the cleaning device 100 will be described below. The auxiliary cleaning roller 95 is arranged in an upper-stream position with respect to the processing unit 50 along a direction of the rolling flow of the intermediate transfer belt 71. More specifically, the auxiliary cleaning roller 95 is arranged in a position opposite from the backup roller 96 across the intermediate transfer belt 71. In other words, auxiliary cleaning roller 95 and the backup roller 96 interposes the intermediate transfer belt 71 in the position there-between, and the intermediate transfer belt 71 is nipped by the auxiliary cleaning roller 95 and the backup roller 96. The auxiliary cleaning roller 95 collects materials adhered onto the surface of the intermediate transfer belt 71 (e.g., the residual toners Z remaining on the intermediate transfer belt 71 after the secondary transfer operation) therefrom to temporarily hold on a peripheral surface thereof. The collected residual toners Z are temporarily maintained on the surface of the auxiliary cleaning roller 95 and released in a predetermined timing, in which the released residual toners Z should not interfere with the toner images primarily transferred on the surface of the intermediate transfer belt 71.

The timing to release the residual toners Z on the surface of the intermediate transfer belt 71 will be described with reference to FIGS. 5A-5E. In the example, it is assumed that images are formed on three pieces of recording sheets. Firstly, toner images for a first recording sheet and a second recording sheet are formed on the surfaces of photosensitive drums 51 in the processing unit 50. In FIGS. 5A-5E, the photosensitive drum 51Y represents the four photosensitive drums 51, and the photosensitive drums 51M, 51C, 55K are omitted for a purpose to simplify the illustration. The toner images for the first recording sheet and the second recording sheet are primarily transferred onto respective positions on the intermediate transfer belt 71 (see FIG. 5A). When the toner image for the first recording sheet reaches the secondary transfer position P2, the toner image is secondarily transferred onto the surface of the first recording sheet (see FIG. 5B). Meanwhile, a toner image for a third recording sheet is formed in the processing unit 50 and transferred primarily onto the surface of the intermediate transfer belt 71. As the intermediate transfer belt 71 rolls, the toner images are transferred secondarily on the surfaces of the second recording sheet and the third recording sheet respectively (see FIGS. 5C and 5D).

In the meantime, the auxiliary cleaning roller 95 collects the residual toners Z remaining after the secondary transfer operation from the intermediate transfer belt 71 during a period between start of the image forming for the first recording sheet and completion of the secondary transfer of the toner image onto the third recording sheet. As soon as the secondary transfer operation of the toner image onto the third recording sheet is completed, the auxiliary cleaning roller 95 releases the once collected residual toners Z on the intermediate transfer belt 71 (see FIG. 5D). More specifically, the residual toners Z remaining from the secondary transfer operations for the first and second recording sheets are transferred back onto the surface of the intermediate transfer belt 71. In this regard, the residual toners Z remaining after the secondary transfer operation of the toner image for the third recording sheet is not collected. Therefore, the released residual toners Z from the secondary transfer operations for the first and second recording sheets may be laid over the residual toners Z remaining from the secondary transfer operations for the third recording sheet. Thereafter, the released residual toners Z and the remaining residual toners Z are removed from the surface of the intermediate transfer belt 71 and collected by the cleaning device 100, which includes the secondary transfer roller 110 (see FIG. 5E).

The auxiliary cleaning roller 95 is configured to absorb and release the residual toners Z by an effect of the electric field. The auxiliary cleaning roller 95 is manipulated by an auxiliary cleaner bias applying circuit 175 (see FIG. 7) to absorb the residual toners Z when a first level of voltage (e.g., negative voltage), which is lower than a potential of the intermediate transfer belt 71, is applied thereto and release the collected residual toners Z when a second level of voltage (e.g., positive voltage), which is higher than the potential of the intermediate transfer belt 71, is applied thereto.

The cleaning device 100 removes the residual toners Z from the surface of the intermediate transfer belt 71 to clean. The cleaning device 100 includes the secondary transfer roller 110, which also functions as a cleaning roller, a collecting roller 120, a cleaning blade 125, and a waste toner box 130.

The secondary transfer roller 110, as has been described earlier, includes the roller shaft 110A made of a metal and the outer layer 110B made of a porous material surrounding the roller shaft 110A. When the cleaning voltage V2 is applied to the secondary transfer roller 110, the residual toners Z can be absorbed to be removed from the intermediate transfer belt 71 by the effect of the electric field.

The collecting roller 120 is made of a metal (e.g., iron with nickel plating, stainless material, etc.) and arranged in a position to contact the secondary transfer roller 110 at a circumferential surface to be rotated along with the rotation of the secondary transfer roller 110. The collecting roller 120 collects the residual toners Z, which have been removed from the intermediate transfer belt 71 by the secondary transfer roller 110, from the secondary transfer roller 110 in the same method as the secondary transfer roller 110 removes the residual toners Z from the intermediate transfer belt 71 by the effect of the electric field.

More specifically, by applying cleaning voltage, of which absolute value is greater than that of the cleaning voltage V2 to be applied to the secondary transfer roller 110, to a roller shaft 120A of the collecting roller 120, an electric field directed from the secondary transfer roller 110 toward the collecting roller 120 is generated. Due to the effect of the generated electric field, the residual toners Z removed by the secondary transfer roller 110 from the intermediate transfer belt 71 are collected to the collecting roller 120 (see FIG. 2).

It is to be noted that the collecting roller 120 may not necessarily be a driven roller, which is driven along with the rotation of the secondary transfer roller 110, but may be a driving roller, which is rotated by driving force of, for example, the main motor 161. If the collecting roller 120 is a driving roller, slip of the collecting roller 120 with respect to the secondary transfer roller 110 may be effectively prevented.

The cleaning blade 125 is made of, for example, rubber and is arranged to be in contact with the circumferential surface of the collecting roller 120 at one edge thereof. The cleaning blade 125 scrapes off the residual toners Z from the collecting roller 120 and collects the removed toners Z to store in the waste toner box 130.

The waste toner box 130 is formed to have a shape of a box, which is longer in width and height than depth, and can serve as a container to store the collected residual toners Z therein. The waste toner box 130 is removably installed inside the casing 21 in a position rearward opposite from the intermediate transfer belt 71 across the conveyer path L.

The removable structure of the waste toner box 130 will be described hereinbelow. The casing 21 of the laser printer S is formed to have an attachment section 90 in a lower rear position thereof. In particular, a rear plane 22 of the casing is formed to have an aperture 90A, and the attachment section 90 is exposed to be accessed by a user through the opening 90A. In other words, the aperture 90A serves as an opening, through which the waste toner box 130 is installed in and removed from the attachment section 90. The aperture 90A may be covered by a rear cover 25, which is openable and closable with respect to the aperture 90A. The rear cover 25 is attached to the casing 21 at a lower edge thereof to be pivotable about a hinge (not shown), which is formed at a lower edge of the aperture 90A. When the rear cover 25 pivots about the lower edge to an open position (see FIG. 6), the aperture 90A is exposed, and the user can access the attachment section 90 inside the casing 21 to install the waste toner box 130 through the aperture 90A. In the present embodiment, the secondary transfer roller 110 and the collecting roller 120 are rotatably attached to the waste toner box 130; therefore, when the waste toner box 130 is removed from or installed in the casing 21, the secondary transfer roller 110 and the collecting roller 120 are removed from or installed in the casing 21 along with the cleaning device 100.

The attachment section 90 is formed to have a volume, in which the cleaning device 100 with the waste toner box 130, the secondary transfer roller 110, and the collecting roller 120 is fitted therein. With regard to the secondary transfer roller 110, it is necessary to have the secondary transfer roller 110 in the position to be in contact with the intermediate transfer belt 71; therefore, the attachment section 90 is formed to have an opening (not shown), through which the secondary transfer roller 110 protrudes to be exposed to the intermediate transfer belt 71. When the waste toner box 130 is installed in the attachment section 90, the rear cover 25 may be placed in a closed position (see FIG. 1) to cover the aperture 90A. In the closed position, a rear exterior plane 131 of the waste toner box 130 adjoins the aperture 90A. That is, the rear cover 25 faces the rear exterior plane 131 of the waste toner box 130 through the aperture 90A, and the waste toner box 130 is placed in a correct installed position and restricted from being moved in the direction of depth. When the rear cover 25 is in the open position, the rear exterior plane 131 of the installed waste toner box 130 is exposed through the aperture 90A, and the user may access the waste toner box 130. Thus, the cleaning device 100 including the waste toner box 130 may be removed from the attachment section 90 to be replaced with a new cleaning device 100.

Figure 6:
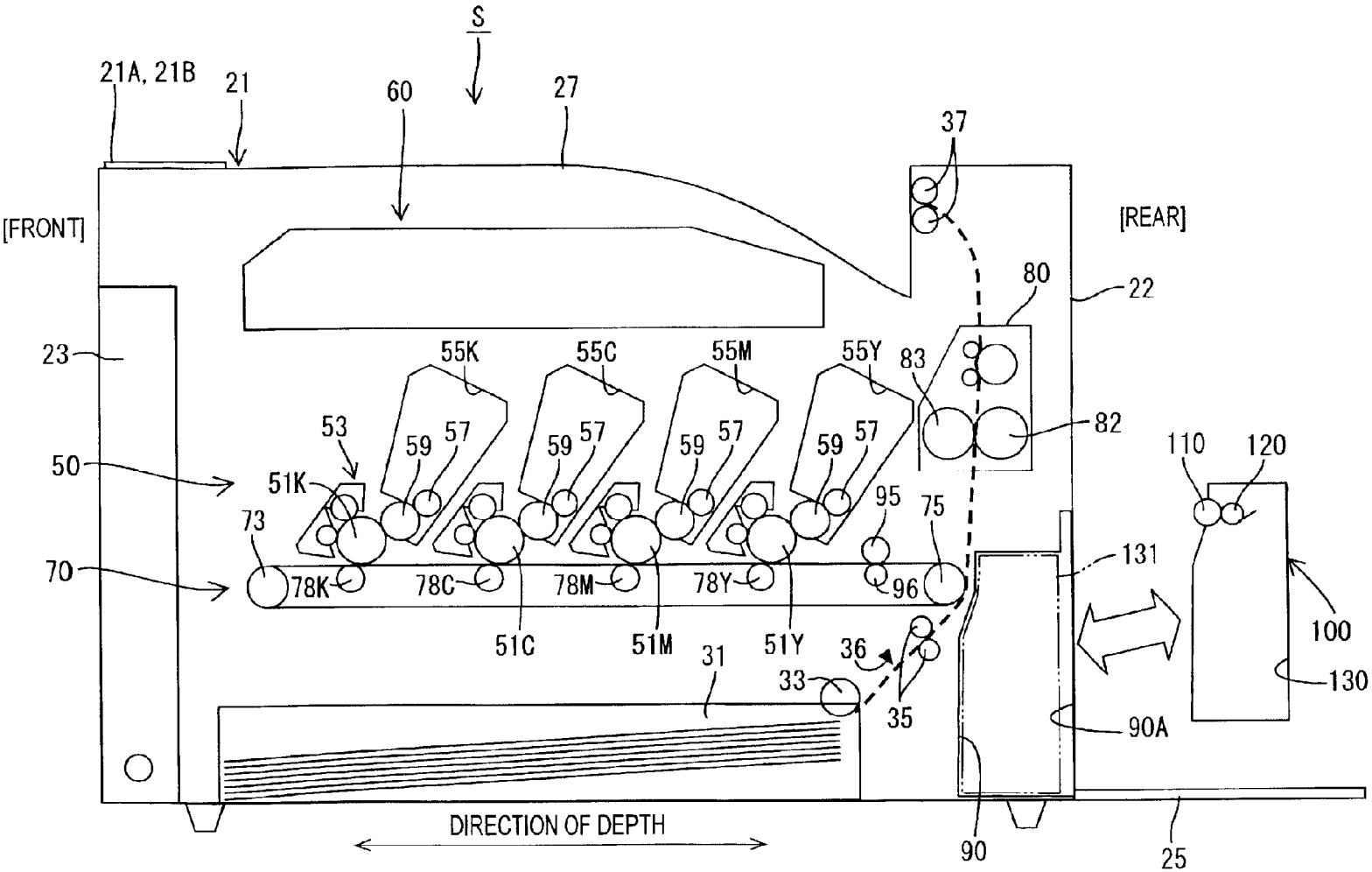
FIG. 6 is a diagram to illustrate an attachable/detachable structure of a waste toner box in the laser printer according to the first embodiment of the present invention.

The attachment section 90 is formed to have a joint part (not shown), by which the waste toner box 130 installed in the attachment section 90 is held in place (indicated by a double-dotted line in FIG. 6). More specifically, when the waste toner box 130 is installed in the attachment section 90, the joint part becomes in contact with a part of the waste toner box 130, and the waste toner box 130 is held in place by the joint part. The joint part may be, for example, a hook protruding upward from a plane inside the attachment section 90 facing the installed waste toner box 130, and the waste toner box 130 may be formed to have a dent in a position to be in contact with the hook. Thus, when the waste toner box 130 is installed in the attachment section 90, the hook may be engaged with the dent, and the engagement may hold the waste toner box 130 in place. However, a method to hold the waste toner box 130 in place in the attachment section 90 is not limited to the joint parts described above. For another example, the attachment section 90 may be configured to press downwardly from a top plane and/or upwardly from a bottom plane to hold the waste toner box 130 when the waste toner box 130 is pushed forward in the attachment section 90.

Figure 7:
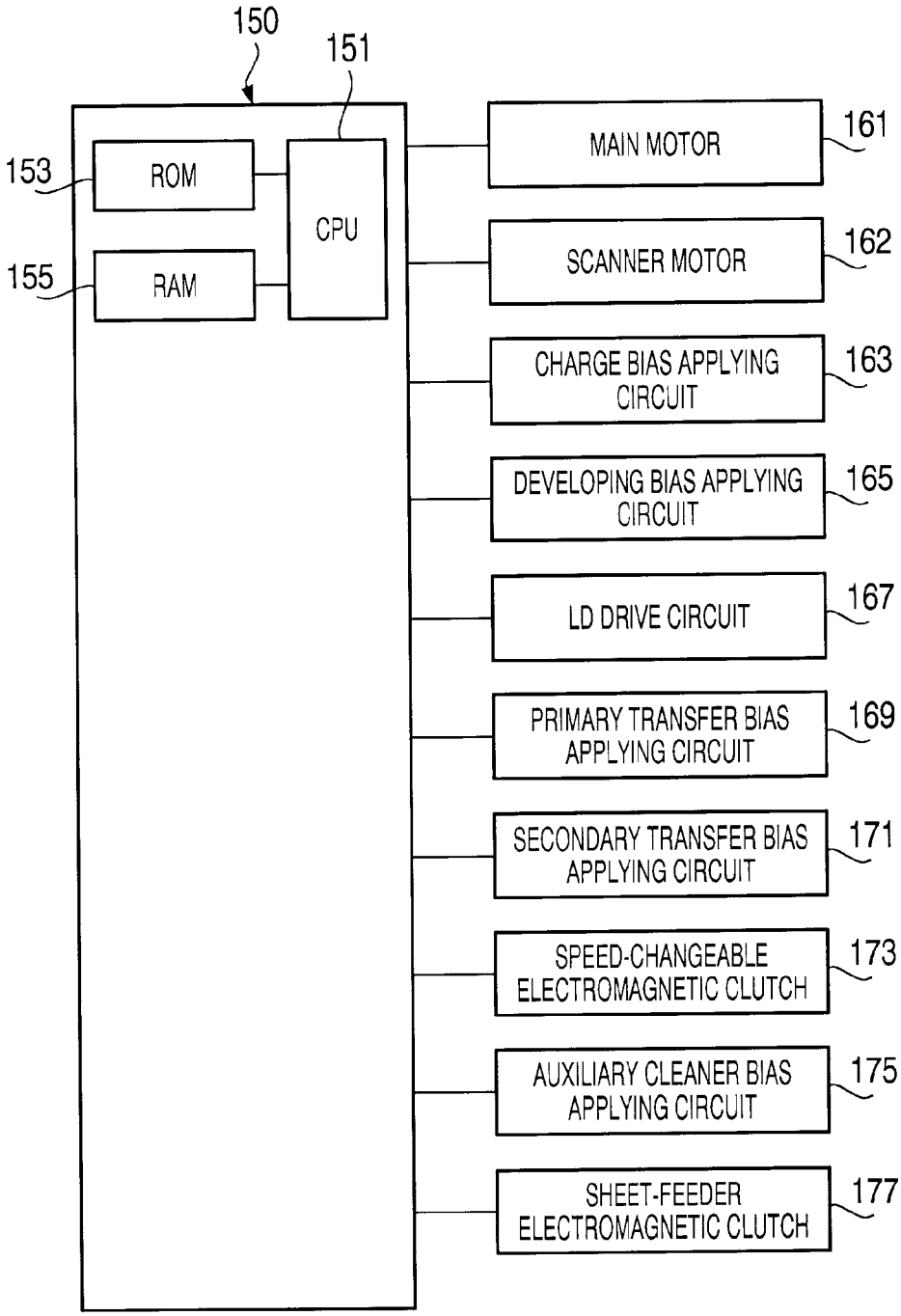
FIG. 7 is a block diagram to illustrate electrical configuration of the laser printer according to the first embodiment of the present invention.

Next, an electrical configuration of the laser printer S will be described with reference to FIG. 7. The laser printer S is provided with an engine controller 150, which includes a CPU 151, a ROM 153, a RAM 155. The CPU 151 in the engine controller 150 controls behaviors of the electrical components, which include the main motor 161, a scanner motor 162, a charge bias applying circuit 163, a developer bias applying circuit 165, an LD drive circuit 167, a primary transfer bias applying circuit 169, a secondary transfer bias applying circuit 171, the speed-changeable electromagnetic clutch 173, the auxiliary cleaner bias applying circuit 175, a sheet-feeder electromagnetic clutch 177. The ROM 153 is a storage device to store various programs including a program to manipulate a printing operation. The RAM 155 serves as a working memory for the CPU 151.

The charge bias applying circuit 163 applies charge voltages to the chargers 53. The developer bias applying circuit 165 applies developer voltages to the developer rollers 59. The primary transfer bias applying circuit 169 applies primary transfer voltages to the primary transfer rollers 78.

The secondary transfer bias applying circuit 171 is a circuit to apply the secondary transfer voltage V1 being negative voltage and the cleaning voltage V2 being negative voltage, of which absolute value is smaller than that of the secondary transfer voltage, to the secondary transfer roller 110. The speed-changeable electromagnetic clutch 173 switches gear trains to be connected to the secondary transfer roller 110 from one to the other to change the rotation velocities of the secondary transfer roller 110 from a velocity being equivalent to the travel velocity of the intermediate transfer belt 71 to a velocity being faster than the travel velocity of the intermediate transfer belt 71, and vice versa.

The auxiliary cleaner bias applying circuit 175 applies first voltage for absorbing the residual toners Z and second voltage for releasing the absorbed toners Z to the auxiliary cleaning roller 95. Additionally, a circuit to apply cleaning voltage to the collecting roller 120 is provided (not shown).

The sheet-feeder electromagnetic clutch 177 switches transmission of driving force to the sheet-feed roller 33 on and off.

Figure 8:
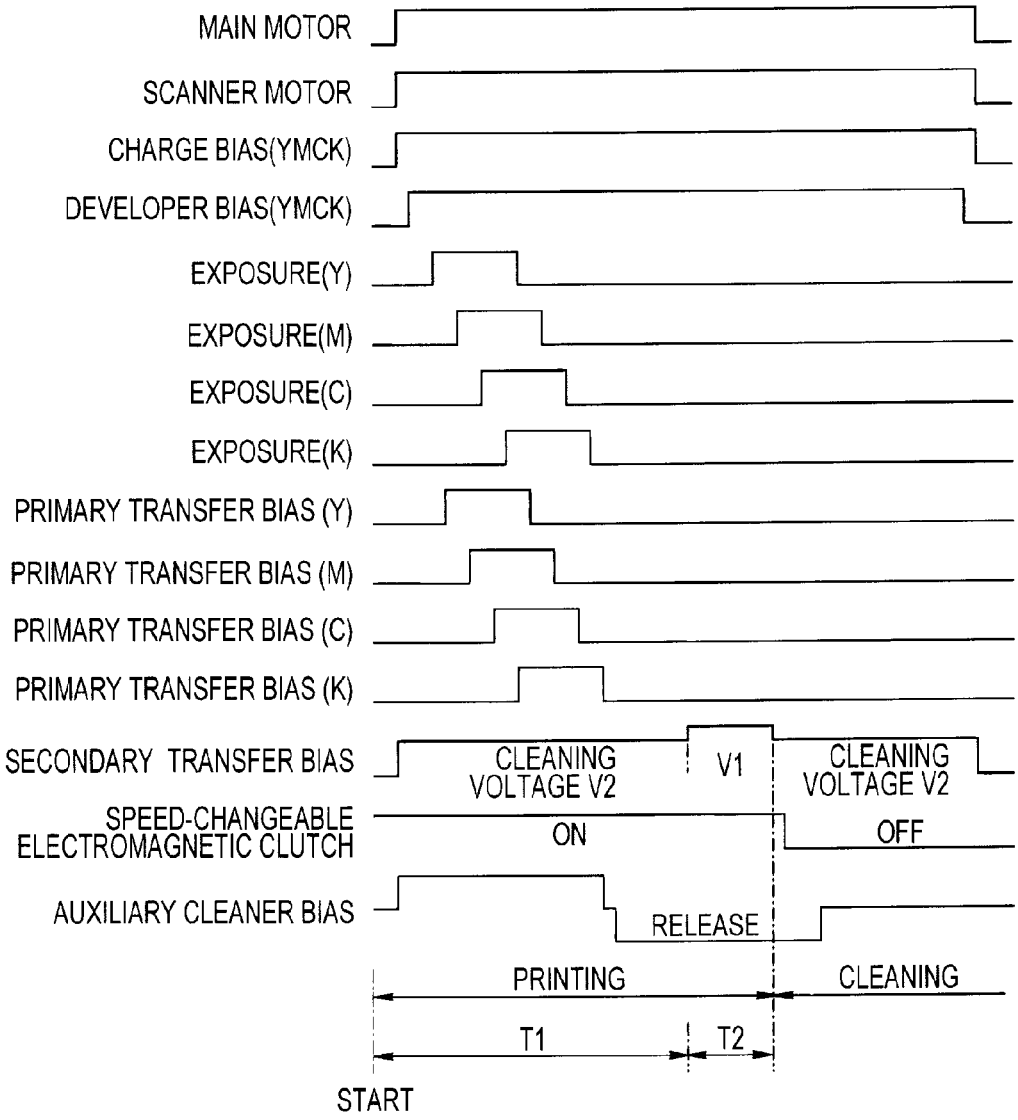
FIG. 8 is a timing chart to illustrate activation timings of biasing circuits in the laser printer according to the first embodiment of the present invention.

Next, a printing operation to print an image on the recording medium in the laser printer S will be described with reference to FIG. 8. When print data in inputted through an external device, such as an information processing device (e.g., a PC) and an image reading device (e.g., an image scanner), the CPU 151 in the engine controller 150 starts a printing operation. In particular, the CPU 151 manipulates the main motor 161 and the scanner motor 162 to rotate and applies charge voltages to the chargers 53 via the charge voltage bias applying circuit 163. Further, the CPU 151 applies developer biases to the developer rollers 59 via the developer bias applying circuit 163.

Thereafter, the CPU 151 manipulates the LD drive circuit 167 to emit laser beams from the laser scanners 61Y, 61M, 61C, 61K toward the photosensitive drums 51Y, 51M, 51C, 51K. Thereby, the circumferential surfaces of the photosensitive drums 51Y, 51M, 51C, 51K are exposed to the laser beams, and latent images corresponding to the print data are drawn in the laser-scanned regions on the circumferential surfaces of the photosensitive drums 51Y, 51M, 51C, 51K.

Thereafter, the positively charged toners held on the developer rollers 59 are supplied to the latent images formed on the circumferential surfaces of the photosensitive drums 51Y, 51M, 51C, 51K. Thus, the latent images are developed, and toner images are formed on the circumferential surfaces of the photosensitive drums 51Y, 51M, 51C, 51K.

Meanwhile, the drive force from the main motor 161 is transmitted to the driving roller 73, and the intermediate transfer belt 71 is rolled. Further, the CPU 151 manipulates the primary transfer bias applying circuit 169 to apply primary transfer biases to the primary transfer rollers 78Y, 78M, 78C, 78K according to timings of exposure of the primary transfer rollers 78Y, 78M, 78C, 78K.

Thereafter, the toner images in Y, M, C, K colors formed on the photosensitive drums 51Y, 51M, 51C, 51K are primarily transferred onto the surface of the intermediate transfer belt 71 at primary transfer positions P1 (see FIG. 5A), in which the photosensitive drums 51Y, 51M, 51C, 51K respectively contact the primary transfer rollers 78 via the intermediate transfer belt 71. The primary transfer of the Y, M, C, K-colored toner images are conducted sequentially in the order described (i.e., the Y-colored toner image is transferred firstly, and the K-colored toner image is transferred fourthly), and the Y, M, C, K-colored toner images are laid over one another on the surface of the intermediate transfer belt 71.

Thereafter, the CPU 151 in the engine controller 150 manipulates the secondary transfer bias applying circuit 171 to apply the secondary transfer voltage V1 to the secondary transfer roller 110. By the effect of the secondary transfer voltage V1, the primarily transferred toner images are collectively transferred secondarily onto the recording sheet when the recording sheet fed from the sheet cassette 31 passes the secondary transfer position P2, which is between the intermediate transfer belt 71 and the secondary transfer roller 110. Further, when the recording sheet with the secondary transferred toner images passes through the fixing unit 80, the toner images are thermally fixed thereat. The recording sheet with the fixed images is conveyed in the conveyer path L to reach the upper rear end of the casing 21 and ejected by discharge rollers 37 to be settled on the discharge tray 27. The printing operation ends thereat.

When the printing operation ends, the CPU 151 in the engine controller 150 starts a cleaning operation, in which the intermediate transfer belt 71 is cleaned. In particular, the CPU 151 switches the speed-changeable electromagnetic clutch 173 on. Accordingly, the gear trains are switched, and the secondary transfer roller 110 is placed in condition to rotate in the same direction as the intermediate transfer belt 71 at the secondary transfer position P2 in the faster rotation velocity than the travel velocity of the intermediate transfer belt 71.

Whilst the secondary transfer roller 110 is rotated in the same direction as the intermediate transfer belt 71 in the faster rotation velocity than the travel velocity of the intermediate transfer belt 71, a greater amount of friction is generated between the intermediate transfer belt 71 and the secondary transfer roller 110, and the residual toners Z on the intermediate transfer belt 71 are removed therefrom more easily to be absorbed by the secondary transfer roller 110 with the applied cleaning voltage V2. The residual toners Z absorbed in the secondary transfer roller 110 are collected by the collecting roller 120 and scraped off from the collecting roller 120 by the cleaning blade 125. The scraped residual toners Z are stored in the waste toner box 130.

In the present embodiment, application of the cleaning voltage V2 to the secondary transfer roller 110 is maintained during the printing operation, once the application starts at the beginning of the printing operation, except a period T2 (see FIG. 8), in which the secondary transfer operation is conducted. Therefore, even in a period T1, which ranges from the start of the printing operation until start of the period T2, the residual toners Z are absorbed from the intermediate transfer belt 71, and the surface of the intermediate transfer belt 71 is maintained cleaned.

In the present embodiment described above, an example of the printing operation, in which the image is printed on a single recording sheet, and the cleaning operation, which is conducted after the printing operation, has been described. When images are printed on a plurality of recording sheets, however, it may not be necessary that the cleaning operation is conducted each time after the image is printed on one of the plurality of recording sheets. For example, the cleaning operation may be conducted after the printing operation to print the images on the last recording sheet is completed. In this way, the residual toners Z may be temporarily collected by the auxiliary cleaning roller 95 during the printing operation until the image is printed on the last recording sheet, and the residual toners Z collected by the auxiliary cleaning roller 95 may be released to be collected in one cleaning operation by the secondary transfer roller 110 after the printing operation to print the image on the last recording sheet is completed.

As has been described above, in the laser printer S according to the embodiment, the waste toner box 130 to store the residual toners Z, which is detachably attached to attachment section 90 in the casing 21, is arranged on the opposite side from the intermediate transfer belt 71 across the conveyer path L. Meanwhile, the secondary transfer roller 110 is usable for the cleaning operation, additionally to the secondary transfer operation. Therefore, the secondary transfer roller 110 is required to have cleaning capacity to absorb the residual toners Z from the intermediate transfer belt 71 to remove. Whilst the secondary transfer roller 110 serves to absorb the residual toners Z, the absorbed toners Z may accumulate on the surface of the secondary transfer roller 110. In this regard, when the waste toner box 130 including the secondary transfer roller 110 is replaceable, the cleaning ability of the secondary transfer roller 110 can be refreshed each time the waste toner box 130 is exchanged with a new waste toner box 130. Thus, the cleaning ability of the secondary transfer roller 110 can be maintained over a lifelong period of the laser printer S. Further, for example, when the secondary transfer roller 110 is not replaceable, it may be necessary to have a secondary transfer roller 110 in a larger size to maintain the cleaning capacity. However, with the replaceable structure, the secondary transfer roller 110 may be configured in a smaller size, and the attachment section 90 and the other structure to accept the secondary transfer roller 110 may be effectively downsized. Thus, an unoccupied space may be achieved in an area surrounding the intermediate transfer belt 71, and the components in the laser printer S may be flexibly arranged in a less limited layout in the casing 21.

Further, when the secondary transfer roller 110 is commonly used in the cleaning operation and the secondary transfer operation, it is not necessary for the laser printer S to have two separate rollers. Rather, a quantity of the components in the laser printer S may be reduced, and a manufacturing cost may be lowered compared to a laser printer, in which a secondary transfer roller and a cleaning roller are separately provided.

According to the laser printer S described above, the processing unit 50 is the tandem-typed processing unit, in which the photosensitive drums 51 are in tandem-alignment, and the secondary transfer roller 110 is arranged in the position to be in contact with the intermediate transfer belt 71 at all times. For example, however, in a laser printer with photosensitive drums being in four-cycle arrangement, the intermediate transfer belt is required to be temporarily detached from the secondary transfer roller 110. In other words, a system to temporarily detach the intermediate transfer belt from the secondary transfer roller and place the intermediate transfer belt back in the contacting position is required. Meanwhile, the laser printer S described in the above embodiment is not required to have such a system to detach the intermediate transfer belt 71 from the secondary transfer roller 110. Therefore, a space which may otherwise be occupied by the detaching system can be effectively used in the laser printer S, and the components in the laser printer S may be flexibly arranged in a less limited layout in the casing 21.

According to the laser printer S described above, the waste toner box 130 is arranged in the position to face the intermediate transfer belt 71 horizontally along the direction of depth. Therefore, the laser printer S can be designed to be smaller in height compared to a laser printer, in which the waste toner box is arranged in a position to vertically face the intermediate transfer belt 71.

In the laser printer S described above, the auxiliary cleaning roller 95 holds temporarily the adhesive materials collected from the intermediate transfer belt 71. In this regard, the adhesive materials may not necessarily be removed from the intermediate transfer belt 71 each time an image is printed on a recording sheet. Rather, when images are printed on a plurality of recording sheets successively, a time period for the cleaning operation to be performed in between the printing operations can be omitted. In other words, an image printing operation to form images on a plurality of recording sheets successively can be performed in a length of period, which is equivalent to a printing operation period to print images on a plurality of recording sheets successively in the conventional printing apparatus with the cleaning device disposed on the same side as the intermediate transfer belt across the sheet conveyer path. Thus, image-printing performance can be maintained in the laser printer S according to the above-described embodiment.

According to the laser printer S in the above-described embodiment, the rotation velocity of the secondary transfer roller 110 is increased to be higher than the moving velocity of the intermediate transfer belt 71 during the cleaning operation. Due to the speed difference between the secondary transfer roller 110 and the intermediate transfer belt 71, the surface of the secondary transfer roller 110 can be prevented from being filled with the removed residual toners Z in a reason described below, and cleaning ability of the secondary transfer roller 110 may be prevented from being lowered.

As has been described above, the outer layer 110B of the secondary transfer roller 110 is made of a porous material; therefore, the toners Z removed from the intermediate transfer belt 71 may be caught in the pores in the outer layer 110B. It is found by the applicant that a time period, in which the residual toners A on the intermediate transfer belt 71 are pressed against the secondary transfer roller 110, can be shortened when the rotation velocity of the secondary transfer roller 110 is higher than the moving velocity of the intermediate transfer belt 71. Therefore, a less amount of the residual toners Z may be pressed into the pores in the secondary transfer roller 110. Thus, the pores on the secondary transfer roller 110 can be prevented from being filled with the removed residual toners Z, and cleaning ability of the secondary transfer roller 110 may be maintained for a longer time.

Second Embodiment

Figure 9:
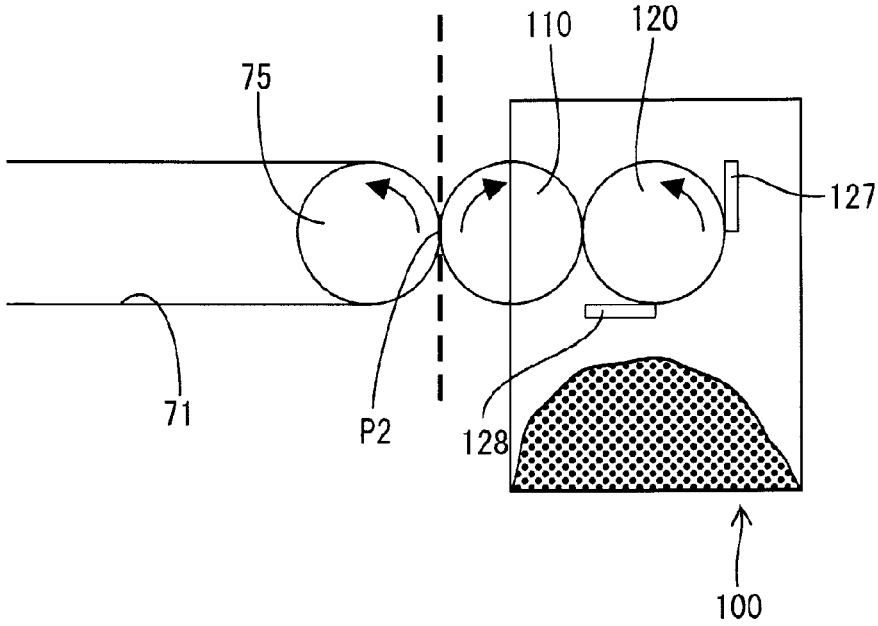
FIG. 9 is a diagram to illustrate a behavior of a collecting roller rotating in a normal direction in the cleaning device of the laser printer according to a second embodiment of the present invention.

A second embodiment of the present invention will be described below with reference to FIGS. 9 and 10. In the second embodiment, rotating direction of the secondary transfer roller 110 can be switched from one to the other, and vice versa. It is to be noted, in the first embodiment, that the rotation velocities of the secondary transfer roller 110 are switched between the secondary transfer operation and the cleaning operation. That is, the secondary transfer roller 110 is rotated in the equivalent rotation velocity to the moving velocity of the intermediate transfer belt 71 during the secondary transfer operation and in the faster rotation velocity with respect to the moving velocity of the intermediate transfer belt 71 during the cleaning operation. Meanwhile, the rotation direction of the secondary transfer roller 110 is maintained unchanged.

Figure 10:
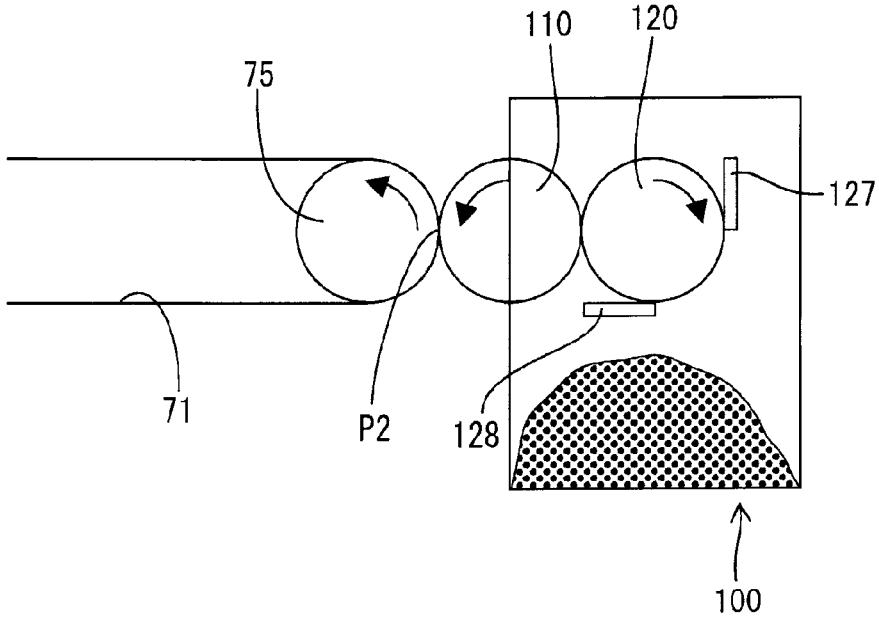
FIG. 10 is a diagram to illustrate a behavior of the collecting roller rotating in a reverse direction in the cleaning device of the laser printer according to the second embodiment of the present invention.

In the second embodiment, the CPU 151 controls the rotation directions of the secondary transfer roller 110 and manipulates the secondary transfer roller 110 to rotate in the same direction as the intermediate transfer belt 71 during the secondary transfer operation (see FIG. 9) and in the opposite direction from the intermediate transfer belt 71 during the cleaning operation (see FIG. 10).

In this regard, concerning the rotating directions of the secondary transfer roller 110 and the intermediate transfer belt 71, the "same direction" refers to the direction of travel of the secondary transfer roller 110 and the intermediate transfer belt 71 at the secondary transfer position P2. That is, when the secondary transfer roller 110 and the intermediate transfer belt 71 are in the same rotating direction, the secondary transfer roller 110 and the intermediate transfer belt 71 are moved in the same direction at the secondary transfer position P2 (e.g., upward in FIG. 9). Meanwhile, when the secondary transfer roller 110 is rotated in the opposite direction from the intermediate transfer belt 71, the secondary transfer roller 110 and the intermediate transfer belt 71 are moved in the different directions from each other at the secondary transfer position P2 (e.g., the intermediate transfer belt 71 moves upward in FIG. 10, and the secondary transfer roller 110 moves downward in FIG. 10).

When the secondary transfer roller 110 is rotated in the direction opposite from the intermediate transfer belt 71, the friction force generated between the secondary roller 110 and the intermediate transfer belt 71 is increased to be greater than the friction force caused between the secondary roller 110 and the intermediate transfer belt 71 being rotated in the same direction. Therefore, the residual toners Z can be more easily removed from the intermediate transfer belt 71 and absorbed in the secondary transfer roll 110 by the effect of the friction force. Thus, the cleaning performance can be improved.

Further, the laser printer S according to the second embodiment is equipped with a first cleaning blade 127 and a second cleaning blade 128 to scrape off the collected toners Z from the collecting roller 120. The first cleaning blade 127 scrapes off the toners Z from the collecting roller 120 when the secondary transfer roller 110 rotates in the same direction as the intermediate transfer belt 71 and the collecting roller 120 rotates in a normal direction (e.g., counterclockwise in FIG. 9). The second cleaning blade 128, on the other hand, scrapes off the toners Z from the collecting roller 120 when the secondary transfer roller 110 rotates in the opposite direction from the intermediate transfer belt 71 and the collecting roller 120 rotates in a reverse direction (e.g., clockwise in FIG. 10).

Thus, the toners Z adhered to the collecting roller 120 are removed therefrom regardless of the rotating directions of the collecting roller 120 as long as the collecting roller 120 is rotated. Therefore, the outer surfaces of the collecting roller 120, the secondary transfer roller 110, and the intermediate transfer belt 71 can be cleaned at all times during the operations.

The rotating directions of the secondary transfer roller 110 may be changed by, for example, an electromagnetic clutch, which switches the gear trains to be connected to the secondary transfer roller 110 from one to the other and vice versa, as mentioned in the first embodiment. For another example, the secondary transfer roller 110 may be provided with a motor (not shown) to specifically rotate the secondary transfer roller 110, and rotating directions of the motor may be controlled by the CPU 151.

Third Embodiment

Figure 11:
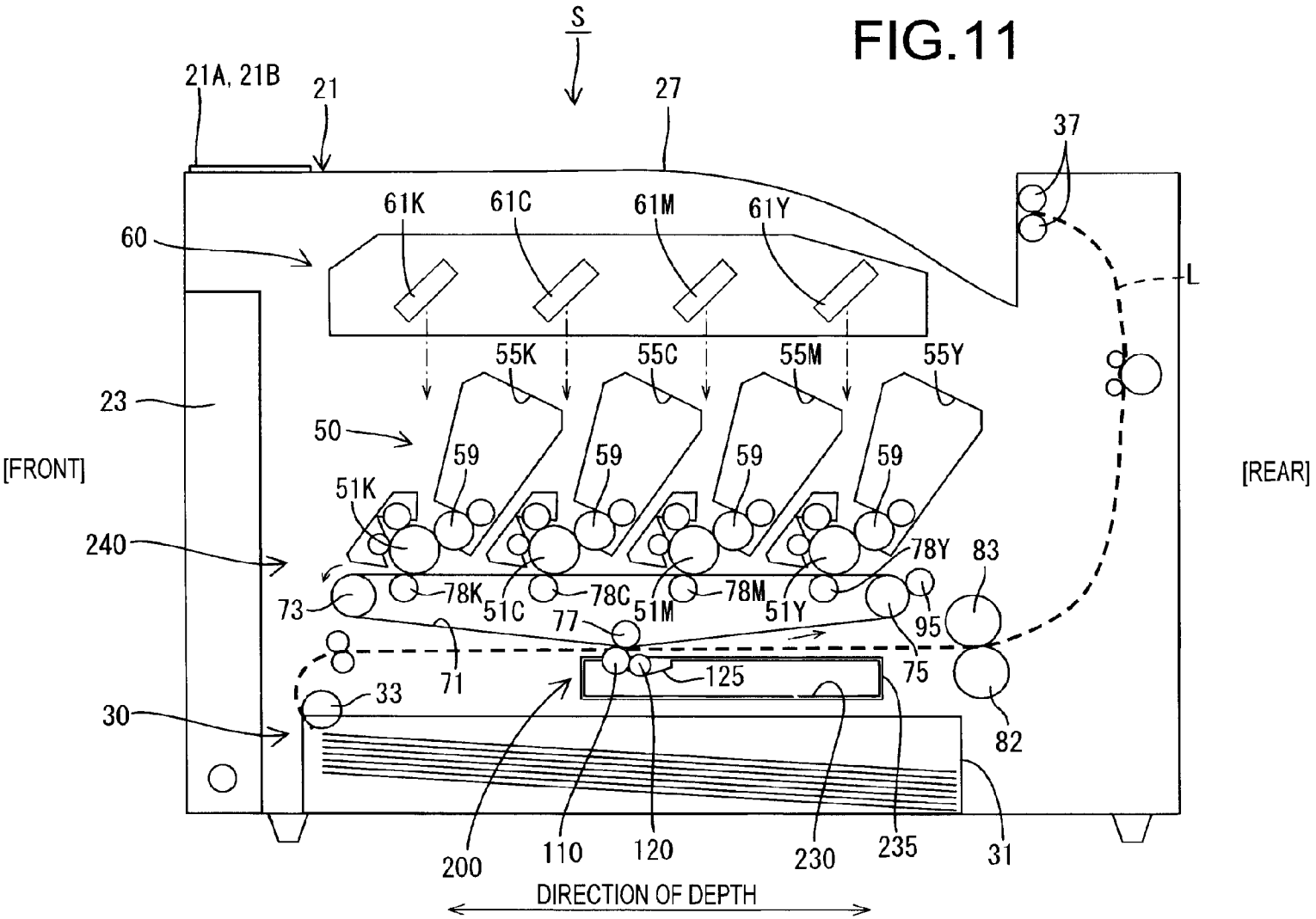
FIG. 11 is a cross-sectional view of the laser printer according to a third embodiment of the present invention.
Figure 12:
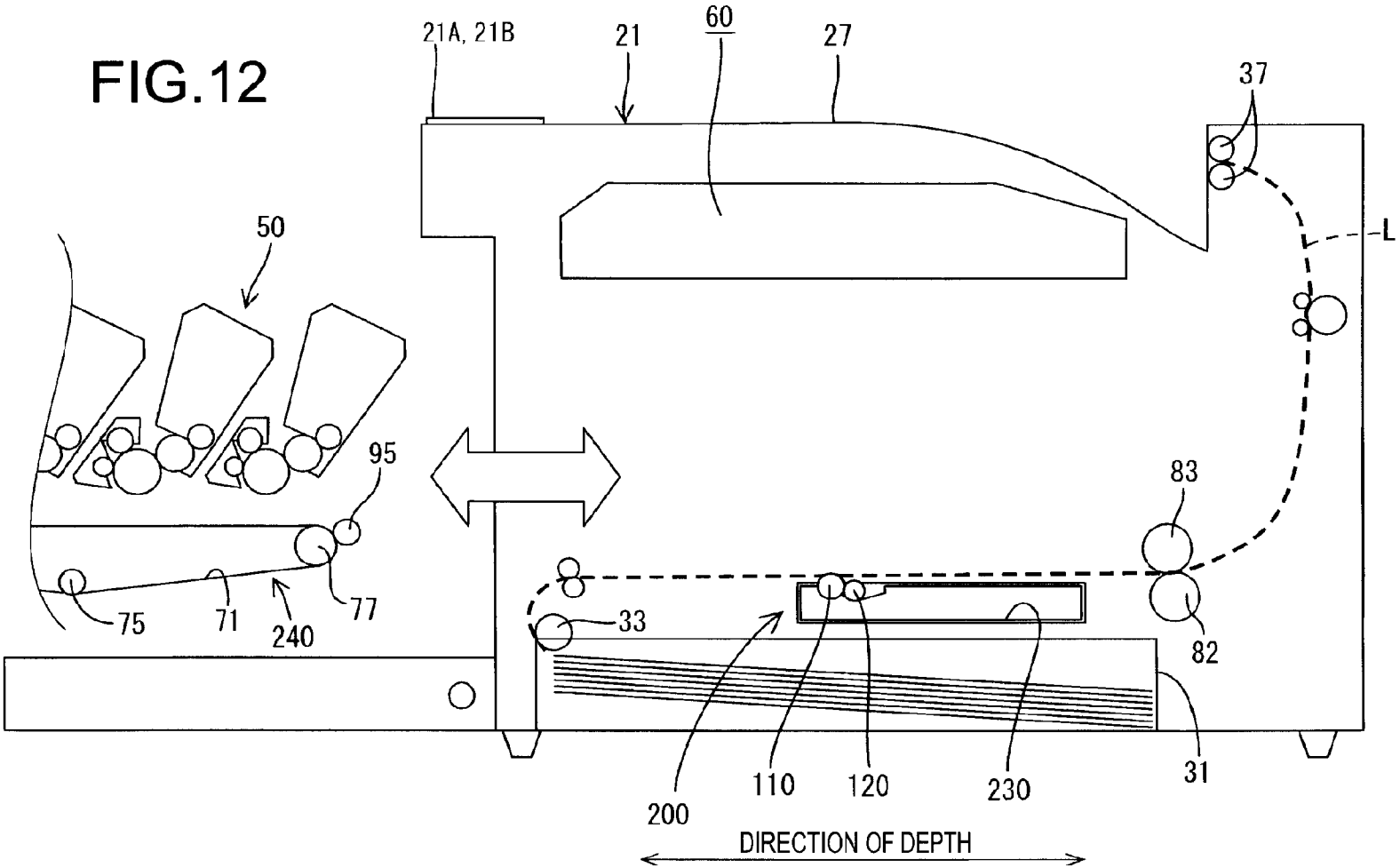
FIG. 12 is a diagram to illustrate an attachable/detachable structure of a waste toner box in the laser printer according to the third embodiment of the present invention.
Figure 13:
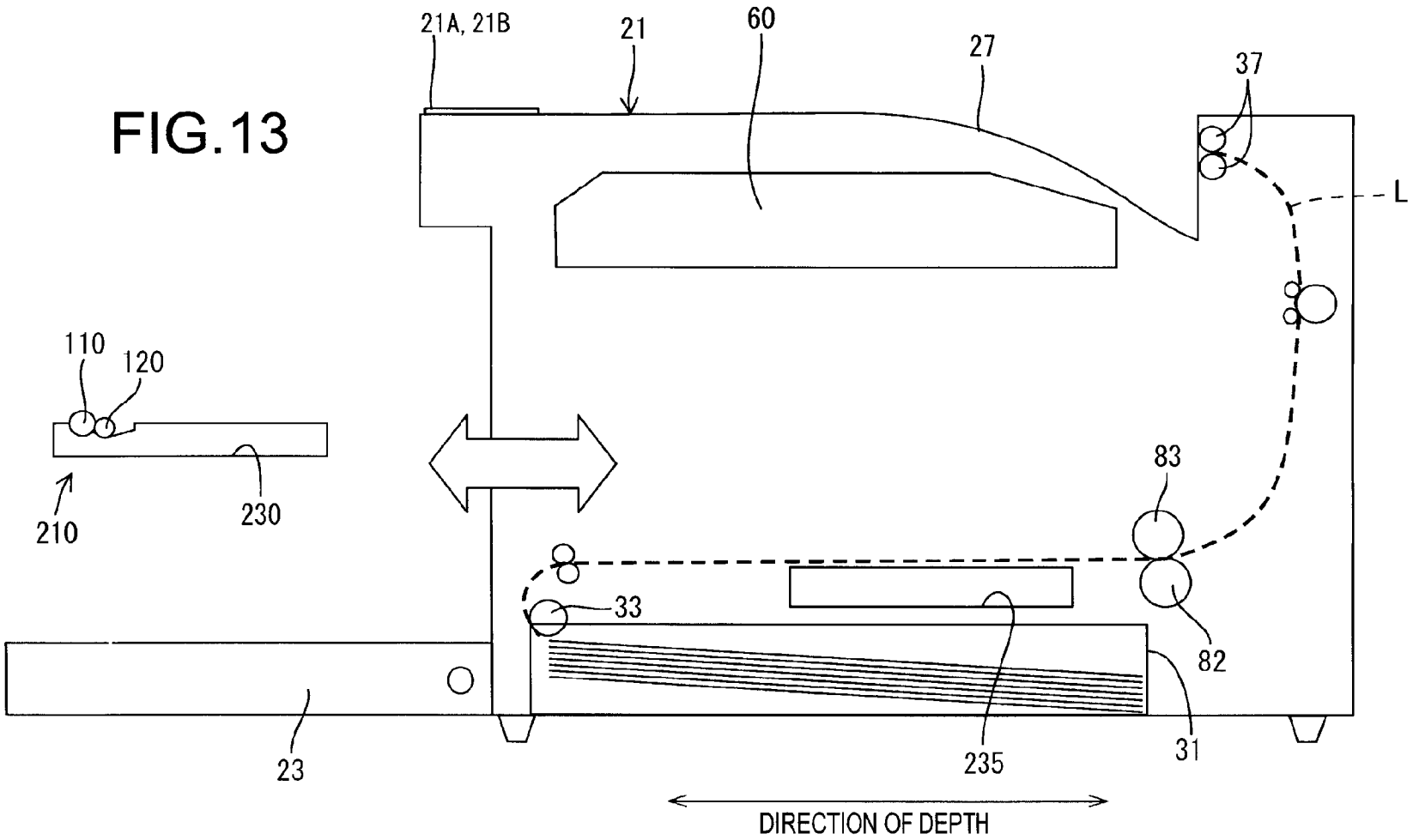
FIG. 13 is a diagram to illustrate the attachable/detachable structure of the waste toner box in the laser printer according to the third embodiment of the present invention.

A third embodiment of the present invention will be described below with reference to FIGS. 11 through 13. In the first embodiment, the waste toner box 130 in the cleaning device 100 is arranged on the opposite side of the intermediate transfer belt 71 across the conveyer path L, and the casing 21 is formed to have the attachment section 90, to which the waste toner box 130 is detachably attached. More specifically, the waste toner box 130 is detachably attached to the attachment section 90 formed in the rear section of the casing 21 with respect to the intermediate transfer belt 71, and when the waste toner box 130 is detached from or attached to the attachment section 90, the rear cover 25 is opened to expose the attachment section 90.

In the third embodiment, the laser printer S is similar to the laser printer S in the first embodiment in that a waste toner box 230 in a cleaning device 200 is arranged in a position opposite from the intermediate transfer belt 71 across the conveyer path L, and the casing 21 is formed to have an attachment section 235 in order to detachably attach the waste toner box 230 to the attachment section 235. Meanwhile, the laser printer S in the third embodiment is different from the laser printer S in the first embodiment in that the conveyer path L originates at a front end of the sheet cassette 31 and in arrangement and attaching procedure of the waste toner box 230 in the casing 21.

More specifically, in the laser printer S according to the third embodiment, the sheet-feeder unit 30, the intermediate transfer belt unit 240, the processing unit 50, and the scanner unit 60 are arranged in stack, from bottom to top, in the order mentioned. The conveyer path L, as indicated in a dotted line in FIGS. 11-13, starts from an upper-front section of the sheet-feeder unit 30 immediately and turns rearward to turn over the recording sheet. The conveyer path L extends further toward the rear of the casing 21. At the rear section of the casing 21, the conveyer path L turns upward to reach the upper-rear end in the casing 21. At the upper-rear end in the casing 21, the conveyer path L turns frontward to reach the discharge tray 27, which is formed in the top plane of the casing 21.

The intermediate transfer belt unit 240 includes the driving roller 73, the backup roller 75, a tension roller 77, and the intermediate transfer belt 71, which rolls around the driving roller 73, the backup roller 75, and the tension roller 77.

The tension roller 77 applies tensile force to the intermediate transfer belt 71 and is arranged in an intermediate position between the driving roller 73 and the backup roller 75 along the direction of depth and in a lower position with respect to the driving roller 73 and the backup roller 75 along the vertical direction. In a lower position with respect to the tension roller 77, the secondary transfer roller 110 is arranged to face the tension roller 77 across the intermediate transfer belt 71. The secondary transfer roller 110, additionally to the role of the secondary transfer roller, functions also as the cleaning roller, which can clean the surface of the intermediate transfer belt 71, as a part of the cleaning device 200.

The cleaning device 200 includes the secondary transfer roller 110, the collecting roller 120, the cleaning blade 125, and the waste toner box 230. The waste toner box 230 is arranged in the lower position with respect to the intermediate transfer belt 71 across the conveyer path L. The cleaning device 200 including the waste toner box 203 is detachably attached to the attachment section 235, which is formed in the upper position with respect to the sheet-feed cassette 30. The attachment section 235 is formed to have a shape of a shallow box, in which the cleaning device 200 including the waste toner box 230 can be installed from above.

The waste toner box 230 is a container to store the collected residual toners Z and is formed to have an elongated shape to be longer in the direction of depth and shorter in height in order to be settled in the position between the intermediate transfer belt 71 and the sheet-feed cassette 31. When the front cover 23 on the front side of the casing 21 is opened (see FIG. 12), and when the processing unit 50 and the intermediate transfer belt unit 70 are removed from the casing 21, the waste toner box 230 is exposed (see FIG. 13). When the waste toner box 230 is exposed, the cleaning device 200 including the waste toner box 230, the secondary transfer roller 110, and the collecting roller 120 can be removed from and installed in the attachment section 235.

Thus, according to the laser printer S in the third embodiment, the waste toner box 230 containing the residual toners Z is arranged in the position opposite from the intermediate transfer belt 71 across the conveyer path L, and the waste toner box 230 is detachably attached to the casing 21 via the attachment section 235. Whilst the secondary transfer roller 110 may be required to have cleaning ability to remove the residual toners Z from the intermediate transfer belt 71, with the replaceable waste toner box 130, the cleaning ability of the secondary transfer roller 110 may be refreshed to be maintained over a lifelong period of the laser printer S. Further, for example, when the secondary transfer roller 110 is not replaceable, it may be necessary to have a secondary transfer roller 110 in a larger size to maintain the cleaning ability. However, with the replaceable structure, the secondary transfer roller 110 may be configured in a smaller size, and the attachment section 235 and the other structure to accept the secondary transfer roller 110 may be effectively downsized. Thus, an unoccupied space may be achieved in an area surrounding the intermediate transfer belt 71, and the components in the laser printer S may be flexibly arranged in a less limited layout in the casing 21.

According to the laser printer S described above in the third embodiment, the waste toner box 230 is arranged in the position to vertically face the intermediate transfer belt 71 along the direction of height. Therefore, it may be difficult to design the laser printer S to be smaller in height compared to the laser printer S according to the first embodiment. However, unit components in larger sizes, such as the processing unit 50, the intermediate transfer belt unit 70, and the cleaning device 200, can be accessed by the user to be removed from the casing 21 easily through the front face of the laser printer S.

Fourth Embodiment

Figure 14:
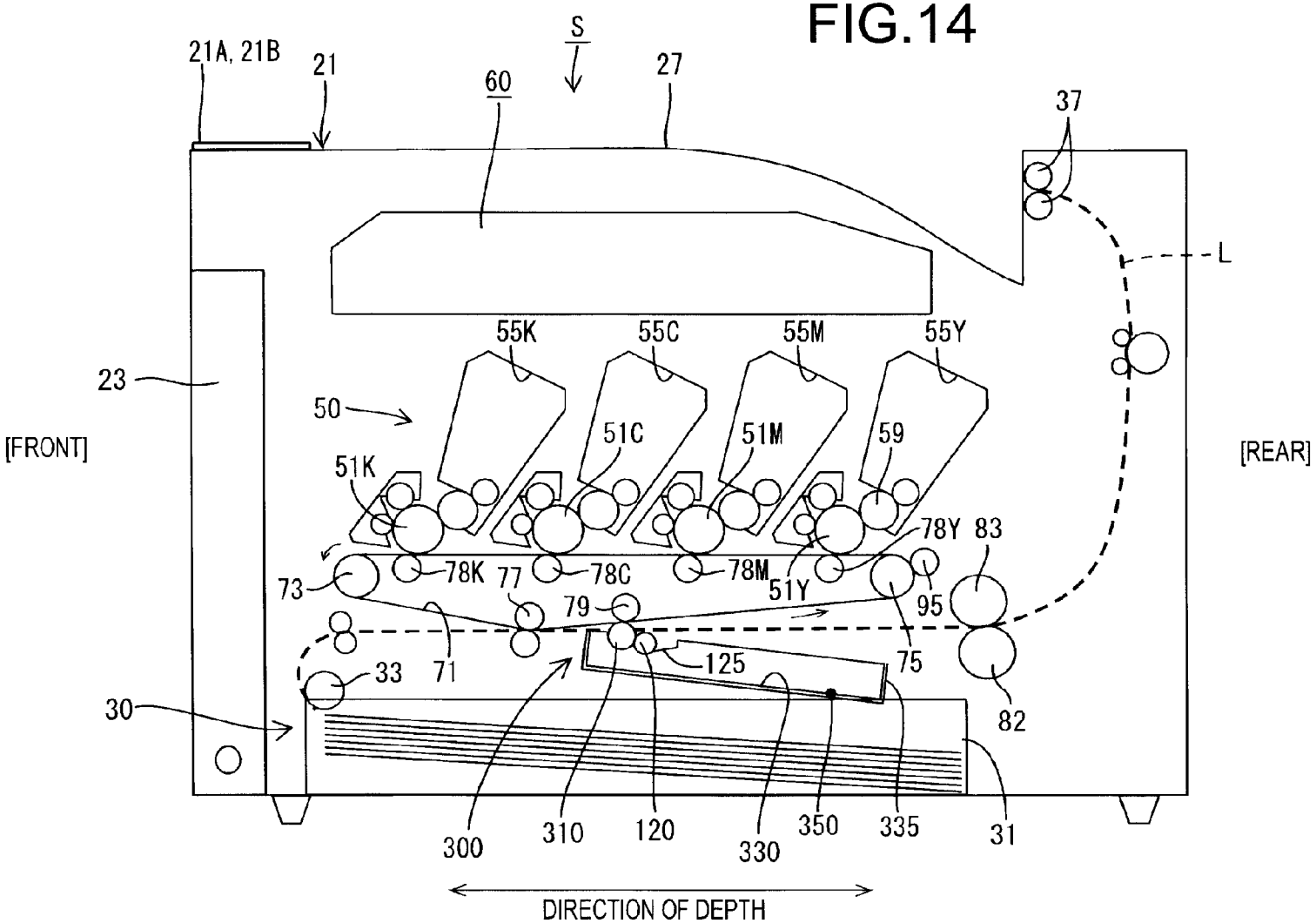
FIG. 14 is a cross-sectional view of the laser printer, with the cleaning device in a cleaning position, according to a fourth embodiment of the present invention.
Figure 15:
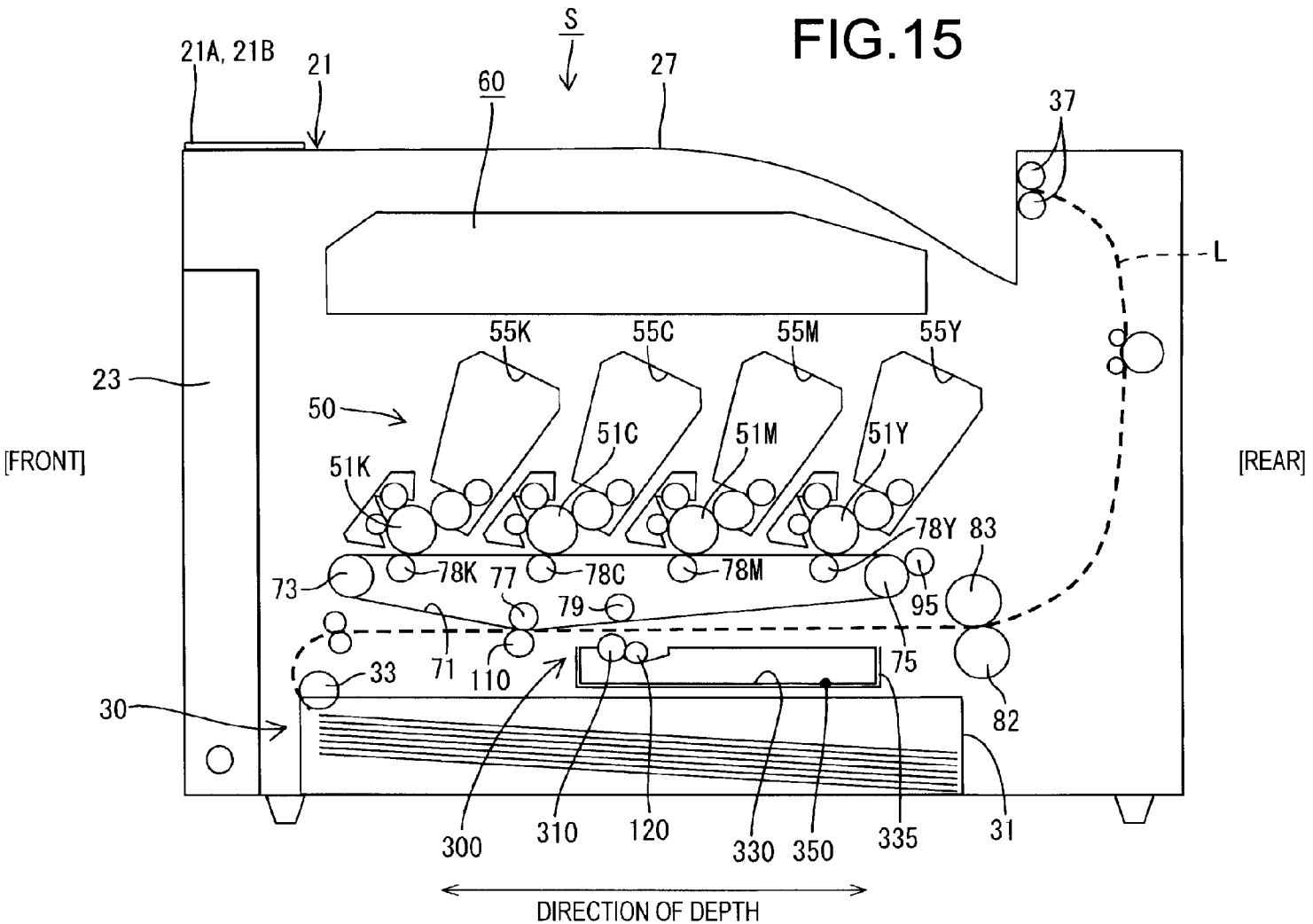
FIG. 15 is a cross-sectional view of the laser printer, with the cleaning device in a standby position, according to a fourth embodiment of the present invention.

A fourth embodiment of the present invention will be described below with reference to FIGS. 14 and 15. In the first through third embodiments, the secondary transfer roller 110 has the roles of the secondary transfer roller and the cleaning roller and serves as a part of the cleaning device 100, 200.

The laser printer S in the fourth embodiment is different from the laser printer S according to the preceding embodiments in that a cleaning roller 310 is provided separately from the secondary transfer roller 110. In particular, the laser printer S is equipped with a cleaning device 300, which includes the cleaning roller 310, the collecting roller 120, a cleaning blade 125, and a waste toner box 330. The cleaning device 300 is detachably attached to an attachment section 335, which is arranged in an upper position with respect to the sheet-feed cassette 31, to be disposed in a position between the sheet-feed cassette 31 and the intermediate transfer belt 71. The attachment section 330 is formed to have a shape of a shallow box, in which the cleaning device 300 including the waste toner box 330 can be installed from above.

The attachment section 335 is pivotable about a hinge 350, which is attached to the casing 21. The cleaning device 300 attached to the attachment section 35 is movable between a cleaning position (see FIG. 14) and a standby position (see FIG. 15) by a moving force from a driving device (not shown).

When in the cleaning position, the cleaning device 300 with the waste toner box 330 is in an inclined posture, in which a front end thereof is higher and a rear end thereof is lower. In this posture, the cleaning roller 310 comes in a position opposite from the backup roller 79, which is in a rear position with respect to the tension roller 77, across the intermediate transfer belt 71. In particular, the cleaning roller 310 comes in contact with the backup roller 79 via the intermediate transfer belt 71.

When in the standby position, the cleaning device 300 with the waste toner box 330 is in a horizontal posture, in which the entire cleaning device 300 is retracted in a lower position with respect to the conveyer path L, and the cleaning roller 310 is separated from the intermediate transfer belt 71.

When the recording sheet is fed from the sheet-feed cassette 31 and conveyed in the conveyer path L, the CPU 151 in the engine controller 150 manipulates the driving device to set the cleaning device 300 in the standby position. Therefore, the cleaning device 300 is retracted in the lower position with respect to the conveyer path L, and the recording sheet can be conveyed in the conveyer path L without being interfered with by the cleaning device 300. If the cleaning device 300 is in a position to overlap the conveyer path L whilst the recording sheet is conveyed in the conveyer path L, the cleaning device 300 may interfere with the recording sheet, and sheet jam may occur in the conveyer path L. However, with the cleaning device 300 in the standby position, the interference can be avoided.

When the intermediate transfer belt 71 is cleaned, the CPU 151 in the engine controller 150 manipulates the driving device to move the cleaning device from the standby position to the cleaning position. In the cleaning position, the cleaning roller 310 is in contact with the intermediate transfer belt 71 in the opposite position from the backup roller across the intermediate transfer belt 71. When in contact with the intermediate transfer belt 71, the cleaning roller 310 can clean the surface of the intermediate transfer belt 71.

In the laser printer S according to the fourth embodiment, the waste toner box 330 to contain the residual toners Z is disposed in the position opposite from the intermediate transfer belt 71 across the conveyer path L, whilst the waste toner box 330 is detachably attached to the casing 21 via the attachment section 335. Whilst the cleaning roller 310 may be required to have cleaning ability to remove the residual toners Z from the intermediate transfer belt 71, with the replaceable waste toner box 330, the cleaning ability of the cleaning roller 310 may be refreshed to be maintained over a lifelong period of the laser printer S. Further, with the replaceable structure, the cleaning roller 310 may be configured in a smaller size, and cleaning members surrounding the intermediate transfer belt 71 and the other structure to accept the cleaning roller 310 may be effectively downsized. Thus, an unoccupied space may be achieved in an area surrounding the intermediate transfer belt 71, and the components in the laser printer S may be flexibly arranged in a less limited layout in the casing 21.

For the above-mentioned driving device, for example, a supporting arm (not shown) may be coupled to the attachment section 335, and the supporting arm may be rotated about the hinge 350 by driving force from a motor.

More Examples

Although examples of carrying out the invention have been described, those skilled in the art will appreciate that there are numerous variations and permutations of the laser printer that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

Figure 16:
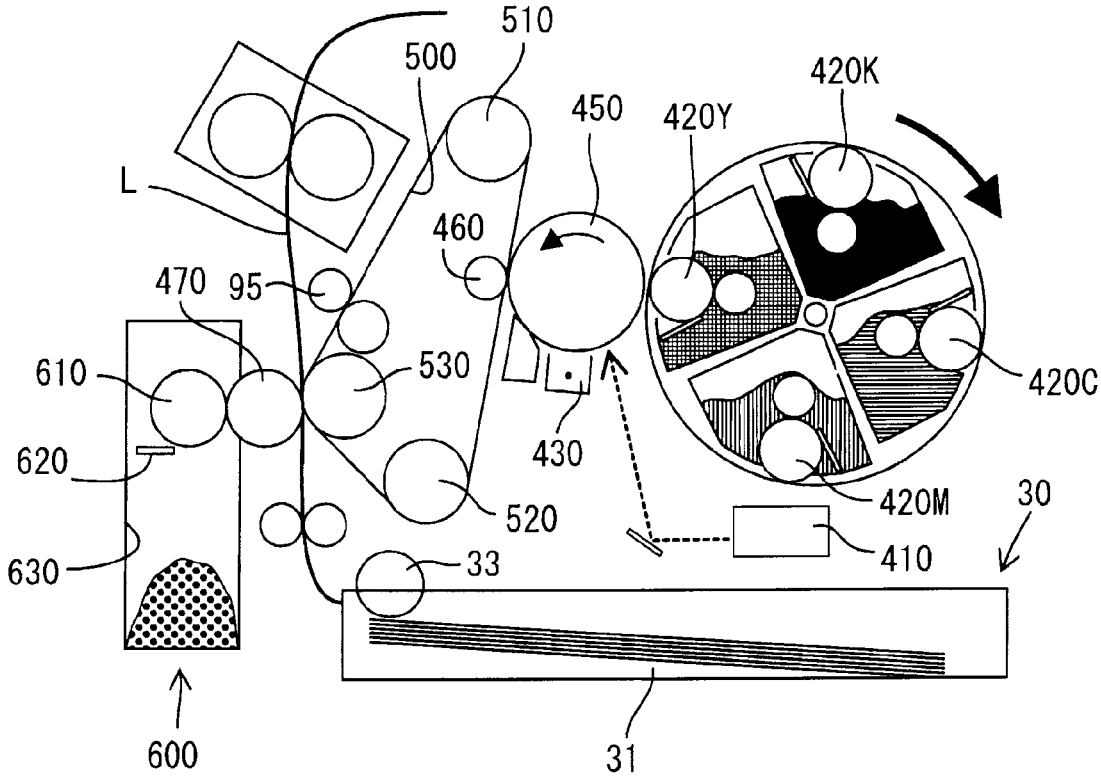
FIG. 16 is an enlarged cross-sectional partial view of the laser printer with four-cycled developer rollers according to the embodiment of the present invention.

For example, the processing unit 50 in the laser printer S may not necessarily have the photosensitive drums 55 in the tandem-alignment, but the processing unit 50 may be a four-cycled processing unit, which has a set of a photosensitive drum 450, a charger 430, a primary transfer roller 460, and an exposure device 410, and four developer rollers 420Y, 420M, 420C, 420K (see FIG. 16). In order to print a multi-colored image on the recording sheet with the four-cycled processing unit, the four-colored toner images are formed on a circumferential surface of the photosensitive drum 400 via the four developer rollers 420Y, 420M, 420C, 420K sequentially whilst an intermediate transfer belt 500 is rolled for four rounds.

The toner images formed on the circumferential surface of the photosensitive drum 450 are transferred primarily onto the surface of the intermediate transfer belt 500 in cooperation with the primary transfer roller 460 and further transferred secondarily onto the recording sheet in cooperation with a secondary transfer roller 470 and a backup roller 530. The secondary transfer roller 470 serves as the secondary transfer roller and the cleaning roller and is a part of a cleaning device 600, which further includes a collecting roller 610, a cleaning blade 620, a waste toner box 630. The waste toner box 630 is disposed on an opposite side from the intermediate transfer belt 71 across the conveyer path L; therefore, a size of the waste toner box 630 may not necessarily be limited by the components surrounding the intermediate transfer belt 71 but may be larger to contain a larger amount of collected waste toners. Further, the components in the laser printer S may be flexibly arranged in a less limited layout in the casing 21.

For another example, the auxiliary cleaning roller 95 may be omitted as long as the cleaning device 100, 200, or 300 is provided. If the auxiliary cleaning roller 95 is omitted, the space, which may otherwise be occupied by the auxiliary cleaning roller 95, may be used effectively for other parts of the laser printer S, and the components in the laser printer S may be flexibly arranged in a less limited layout in the casing 21.

For another example, the collecting roller to collect the absorbed residual toners Z may be replaced with a brush. Further, the collecting roller may even be omitted. When the collecting roller is omitted, for example, the cleaning blade 125 may be disposed in a position to be in contact with the secondary transfer roller 110, and the residual toners adhered on the circumferential surface of the secondary transfer roller 110 may be scraped off by the cleaning blade 125.

For another example, the secondary transfer roller 110 may not necessarily be driven by the driving force from the main motor 161 but may be driven by driving force from a dedicated driving motor. With the dedicated driving motor, the rotation velocities of the secondary transfer roller 110 may be arbitrarily adjusted. For example, when a density index samples are formed on the intermediate transfer belt 71, dense toners may be applied on the intermediate transfer belt 71, and a larger amount of toners may remain unremoved on the intermediate transfer belt 71. Therefore, it may be necessary to increase the velocity difference between the intermediate transfer belt 71 and the secondary transfer roller 110. With the dedicated driving motor, the rotation velocities of the secondary transfer roller 110 may be more finely adjusted, and the residual toners may be more effectively removed from the intermediate transfer belt 71 by the effect of the velocity difference.

Further, when the difference between the moving velocities of the secondary transfer roller 110 and the intermediate transfer belt 71 is increased, the cleaning voltage V2 to be applied to the secondary transfer roller 110 may be controlled by the CPU 151 to be even lower. Thus, electricity to be consumed during the cleaning operation may be reduced.

What is claimed is:

1. An image forming apparatus, comprising:

an image forming unit, which includes a photosensitive member and is configured to form a developer image in a developer agent on the photosensitive member;

an intermediate transfer member, which is arranged in a position to face the photosensitive member;

a primary transfer member, which is configured to transfer the developer image from the photosensitive member to the intermediate transfer member;

a secondary transfer member, which is configured to transfer the developer image from the intermediate transfer member to a recording medium;

a cleaning member, which is configured to remove materials adhered onto the intermediate transfer member;

a container, which is configured to store the materials removed from the intermediate transfer member;

an attachment section, to which the container is detachably attached;

a conveyer, which is configured to convey the recording medium to pass through a position between the intermediate transfer member and the cleaning member;

wherein the secondary transfer member is functional as the cleaning member;

a controller, which is configured to control a difference between a moving velocity of the intermediate transfer member and a moving velocity of the secondary transfer member, wherein the secondary transfer member is configured to transfer the developer image from the intermediate transfer member to the recording medium during a secondary-transfer operation period and serve as the cleaning member during a cleaning operation period, in which the materials is removed from the intermediate transfer member by the secondary transfer member serving as the cleaning member;

wherein the controller controls the difference between the moving velocity of the intermediate transfer member and the moving velocity of the secondary transfer member at a secondary transfer position, in which the developer image is transferred to the recording medium, to be a first difference during the secondary-transfer operation period;

wherein the controller controls the difference between the moving velocity of the intermediate transfer member and the moving velocity of the secondary transfer member at the secondary transfer position to be a second difference during the cleaning operation period; and wherein the second difference is greater than the first difference.

2. The image forming apparatus according to claim 1, wherein the secondary transfer member includes a shaft, which is configured to be controlled by the controller to rotate, and a coat layer, which is configured to surround an outer peripheral of the shaft and made of a porous material; and wherein the controller is configured to control a rotation direction of the secondary transfer member to be a same direction as a moving direction of the intermediate transfer member at the secondary transfer position and control the moving velocity of the secondary transfer member to be greater than the moving velocity of the intermediate transfer member during the cleaning operation period.

3. The image forming apparatus according to claim 1, wherein the controller is configured to control a rotation direction of the secondary transfer member to be an opposite direction from a moving direction of the intermediate transfer member at the secondary transfer position during the cleaning operation period.

4. The image forming apparatus according to claim 3, wherein the cleaning member includes:

a collecting member, which is configured to be rotatably in contact with the secondary transfer member and collect the materials having been removed from the intermediate transfer member by the secondary transfer member while being rotated; and a scraper member, which is configured to scrape off the collected materials from the collecting member and store the scraped materials in the container;

wherein the scraper member includes:

a first scraper, which is configured to scrape off the collected materials from the collecting member when the collecting member is rotated in a first direction; and a second scraper, which is configured to scrape off the collected materials from the collecting member when the collecting member is rotated in a second direction being an opposite direction from the first direction.

5. The image forming apparatus according to claim 1, further comprising:

a voltage applying unit, which is configured to apply cleaning voltage to remove the materials from the intermediate transfer member to the secondary transfer member, wherein the voltage applying unit is configured to lower a level of the cleaning voltage as the second difference between the moving velocity of the intermediate transfer member and the moving velocity of the secondary transfer member is increased during the cleaning operation period.

6. An image forming apparatus, comprising:

an image forming unit, which includes a photosensitive member and is configured to form a developer image in a developer agent on the photosensitive member;

an intermediate transfer member, which is arranged in a position to face the photosensitive member;

a primary transfer member, which is configured to transfer the developer image from the photosensitive member to the intermediate transfer member;

a secondary transfer member, which is configured to transfer the developer image from the intermediate transfer member to a recording medium;

a cleaning member, which is configured to remove materials adhered onto the intermediate transfer member;

a container, which is configured to store the materials removed from the intermediate transfer member;

an attachment section, to which the container is detachably attached;

a conveyer, which is configured to convey the recording medium to pass through a position between the intermediate transfer member and the cleaning member;

wherein the secondary transfer member is functional as the cleaning member; and an auxiliary cleaning member, which is configured to temporarily collect the materials from the intermediate transfer member and release the collected materials back onto the intermediate transfer member in a timing, in which the developer image to be transferred to the intermediate transfer member is prevented from being laid over the released materials.

7. The image forming apparatus according to claim 1, wherein the image forming unit is a tandem-typed image forming unit, in which a plurality of developer images formed on a plurality of photosensitive members are transferred to the intermediate transfer member by the primary transfer member in the position to face the plurality of photosensitive members.

8. The image forming apparatus according to claim 1, further comprising:

a casing, which is configured to serve as a chassis for the image forming apparatus;

an aperture, through which the container accesses inside the casing and is detachably attached to the attachment section; and a cover, which is configured to cover and uncover the aperture, wherein the container is detachably attached to the attachment section having an exterior plane thereof to adjoin the aperture.

9. The image forming apparatus according to claim 1, further comprising:

an operation unit, through which a user manipulates the image forming apparatus, wherein the image forming apparatus is configured to have a front face, on which the operation unit is arranged, and a rear face, which is on an opposite side from the front face, along a direction of depth;

wherein the container is arranged in a position to face the intermediate transfer member along the direction of depth.

10. The image forming apparatus according to claim 1, wherein the conveyer includes a guide path, which is configured to guide the recording medium to the position between the intermediate transfer member and the cleaning member; and wherein the container is arranged in a position opposite from the intermediate transfer member across the guide path.

11. The image forming apparatus according to claim 10, wherein the cleaning member is provided separately from the secondary transfer member and is movable between a cleaning position, in which the cleaning member is in contact with the intermediate transfer member to remove the materials from the intermediate transfer member, and a standby position, which is opposite from the intermediate transfer member across the guide path.

12. The image forming apparatus according to claim 1, wherein the cleaning member is movably attached to the container and is detachable from the attachment section along with the container.

13. An image forming apparatus, comprising:

an image forming unit, which includes a photosensitive member and is configured to form a developer image in a developer agent on the photosensitive member;

an intermediate transfer member, which is arranged in a position to face the photosensitive member;

a primary transfer member, which is configured to transfer the developer image from the photosensitive member to the intermediate transfer member;

a secondary transfer member, which is configured to have a secondary-transfer function to transfer the developer image from the intermediate transfer member to a recording medium and a cleaning function to remove materials adhered onto the intermediate transfer member;

a container, which is configured to store the materials removed from the intermediate transfer member by the secondary transfer member;

a controller, which is configured to control a difference between a moving velocity of the intermediate transfer member and a moving velocity of the secondary transfer member at a secondary transfer position, in which the developer image is transferred to the recording medium;

wherein the secondary transfer member is configured to transfer the developer image from the intermediate transfer member to the recording medium during a secondary-transfer operation period and functions as the cleaning member during a cleaning operation period, in which the materials is removed from the intermediate transfer member by the secondary transfer member;

wherein the controller controls the difference between the moving velocity of the intermediate transfer member and the moving velocity of the secondary transfer member at the secondary transfer position to be a first difference during the secondary-transfer operation period;

wherein the controller controls the difference between the moving velocity of the intermediate transfer member and the moving velocity of the secondary transfer member at the secondary transfer position to be a second difference during the cleaning operation period; and wherein the second difference is greater than the first difference.

14. The image forming apparatus according to claim 6, wherein the image forming unit is a tandem-typed image forming unit, in which a plurality of developer images formed on a plurality of photosensitive members are transferred to the intermediate transfer member by the primary transfer member in the position to face the plurality of photosensitive members.

15. The image forming apparatus according to claim 6, further comprising:

a casing, which is configured to serve as a chassis for the image forming apparatus;

an aperture, through which the container accesses inside the casing and is detachably attached to the attachment section; and a cover, which is configured to cover and uncover the aperture, wherein the container is detachably attached to the attachment section having an exterior plane thereof to adjoin the aperture.

16. The image forming apparatus according to claim 6, further comprising:

an operation unit, through which a user manipulates the image forming apparatus, wherein the image forming apparatus is configured to have a front face, on which the operation unit is arranged, and a rear face, which is on an opposite side from the front face, along a direction of depth;

wherein the container is arranged in a position to face the intermediate transfer member along the direction of depth.

17. The image forming apparatus according to claim 6, wherein the conveyer includes a guide path, which is configured to guide the recording medium to the position between the intermediate transfer member and the cleaning member; and wherein the container is arranged in a position opposite from the intermediate transfer member across the guide path.

18. The image forming apparatus according to claim 17, wherein the cleaning member is provided separately from the secondary transfer member and is movable between a cleaning position, in which the cleaning member is in contact with the intermediate transfer member to remove the materials from the intermediate transfer member, and a standby position, which is opposite from the intermediate transfer member across the guide path.

19. The image forming apparatus according to claim 6, wherein the cleaning member is movably attached to the container and is detachable from the attachment section along with the container.

20. An image forming apparatus, comprising:

an image forming unit, which includes a photosensitive member and is configured to form a developer image in a developer agent on the photosensitive member;

an intermediate transfer member, which is arranged in a position to face the photosensitive member;

a primary transfer member, which is configured to transfer the developer image from the photosensitive member to the intermediate transfer member;

a secondary transfer member, which is configured to transfer the developer image from the intermediate transfer member to a recording medium;

a cleaning member, which is configured to remove materials adhered onto the intermediate transfer member;

a container, which is configured to store the materials removed from the intermediate transfer member;

an attachment section, to which the container is detachably attached; and a conveyer, which is configured to convey the recording medium to pass through a position between the intermediate transfer member and the cleaning member, wherein the cleaning member is movably attached to the container and is detachable from the attachment section along with the container.

* * * * *